US005497171A

United States Patent [19]

Teres et al.

[11] Patent Number: 5,497,171

[45] Date of Patent: Mar. 5, 1996

[54] ELECTRONIC DISPLAY ARRANGEMENT

[75] Inventors: Yvan Terés, Le Locle; Rolf Klappert, Peseux, both of Switzerland

[73] Assignee: Asulab S.A., Bienne, Switzerland

[21] Appl. No.: 388,884

[22] Filed: Feb. 14, 1995

Related U.S. Application Data

[62] Division of Ser. No. 270,788, Jul. 5, 1994, abandoned, which is a continuation of Ser. No. 730,800, filed as PCT/CH90/00270, Nov. 26, 1990, published as WO91/08563, Jun. 13, 1991, abandoned.

[30] Foreign Application Priority Data

| | | | |
|---|---|---|---|
| Nov. 27, 1989 | [CH] | Switzerland | 4243/89 |
| Dec. 18, 1989 | [FR] | France | 89 16864 |
| Nov. 12, 1990 | [CH] | Switzerland | 3610/90 |

[51] Int. Cl.[6] ..... G09G 3/04

[52] U.S. Cl. ..... 345/43; 345/33

[58] Field of Search ..... 340/756–765; 40/446–452; 313/513–522; 345/33, 43, 59; 359/89

[56] References Cited

U.S. PATENT DOCUMENTS

| | | | |
|---|---|---|---|
| 2,137,360 | 11/1938 | Skelsey | 40/451 |
| 3,897,643 | 8/1975 | Morris, Jr. et al. | 340/756 |
| 3,936,816 | 2/1976 | Murata | 313/521 |
| 4,237,459 | 12/1980 | Cordova | 340/756 |
| 4,794,390 | 12/1988 | Lippman | 340/756 |
| 4,949,081 | 8/1990 | Keller et al. | 340/765 |
| 5,016,002 | 4/1991 | Levanto | 340/756 |

FOREIGN PATENT DOCUMENTS

| | | | |
|---|---|---|---|
| 0180685 | 9/1984 | European Pat. Off. . | |
| 0146285 | 6/1985 | European Pat. Off. . | |
| 588406 | 5/1925 | France . | |
| 2458857 | 6/1979 | France . | |
| 8015997 | 7/1980 | France . | |
| 3816550 | 11/1989 | Germany . | |
| 0010452 | 1/1978 | Japan | 340/756 |

*Primary Examiner*—Jeffery Brier

*Attorney, Agent, or Firm*—Griffin, Butler, Whisenhunt & Kurtossy

[57] ABSTRACT

An electronic display arrangement comprises at least one electro-optical display means, as for example a liquid crystal cell, a certain number of elementary patterns associated with the electro-optical display means, such elementary patterns for the most part conforming to and being based on a series of stylized and selected alpha-numeric characters in the form of a composite mosaic-type structure the grid of which is formed by the patterns which exhibit heterogeneous and complementary contours arranged so as to nest into one another in a manner similar to that of a puzzle, the arrangement being characterized in that the mosaic is divided up by optically passive bands which partially cover over certain of the elementary patterns and form a cutup of the mosaic. The electronic display arrangement is applicable to panels for displaying alpha-numeric characters for the visualization of messages in public places such as railway or airport halls.

20 Claims, 18 Drawing Sheets

ELECTRONIC DISPLAY ARRANGEMENT

This is a division of application Ser. No. 08/270,788, filed Jul. 5, 1994, now abandoned which was a continuation of application Ser. No. 07/730,800 filed Mar. 20, 1992, now abandoned, as a U.S. National Phase application corresponding to PCT/CH90/00270 filed Nov. 26, 1990.

FIELD OF THE INVENTION

This invention concerns an electronic display arrangement intended for visual display of special signs, in particular the alpha-numerical characters.

More specifically, it concerns a display arrangement in which the active display means is constituted by one or several elements, the optical characteristics of which may vary as a function of an electrical energization signal controlled selectively by an electronic control circuit.

In the description to follow reference will be made, in order to designate such elements, to an electro-optical cell of the liquid crystal type. As will be understood, the invention may apply in certain of its characteristics, for instance to a display arrangement including a set of electro-luminescent diodes, more generally designated under the English abbreviation LED, or again to any other display arrangement corresponding to the definition hereinabove.

BACKGROUND OF THE INVENTION

There has already been known, in particular according to the patent application FR-A-2 458 857 an electronic display arrangement including a set of modules which are respectively constituted either by the electrodes of a liquid crystal cell, or by electro-luminescent diodes and which have the form of straight line segments arranged adjacent to one another and abutting by lines and by columns.

On the graphical plan, this arrangement does not give entire satisfaction since it enables display only of "stick" characters, that is to say, under the form of strokes joined to one another.

Furthermore, this arrangement is considerably limited since the modules do not permit the indiscriminate display either of lower case forms or capitals.

Furthermore, the patent application EP 0 46 285 describes a display arrangement of another type, that is to say, structured essentially under the form of a point matrix having n lines and p columns (n being equal to 5 and p equal to 3, in this example).

The pixels of this matrix, that is to say the most elementary patterns each of which forms an electrode individually addressable, have been modified relative to the pixels of the most standard point matrices solely with the purpose of increasing the resolution. Thus, those who conceived such matrix while wishing absolutely to maintain the qualities of low order matrices (typically 5×3) have attempted to increase the number of pixels. At this epoch, they thus started off naturally from a standard material form including rectangular pixels and more particularly square pixels, by definition all identical, and distributed in a homogeneous fashion. The purpose which they set themselves has led to division of said pixels in four, in cutting almost all of them up in a quasi identical manner by means of two diagonals. The resulting structure is thus made up essentially of several repeated groups, each composed of four isosceles triangles. In observing the contours or the envelope of such groups, one readily finds anew the aspect of the original rectangles, the junction of which I constitutes the pattern or grid of the matrix.

It is thus noted that the structure of this arrangement remains within a concept which is very regular and-ordered, with a strict and almost identical repetition of the groups and pixels responding to the definition of material type displays.

This special conception of electro-optical displays exhibits major difficulties. Effectively, the form of the displayable characters is determined from the outset by the material arrangement of the electrodes or pixels. Thus, starting out from a plan which is rigid and determined, the user has as his only possibility to select within such given plan the pixels which are at his disposal in order to obtain a letter or a digit. It is thus impossible for him to visualize stylized characters since the capacities of the arrangements are confined within the original pattern.

Consequently, although the arrangement proposed in this patent application answers the desires of increasing the resolution of display arrangements of the material type by increasing the number of pixels, it is understood that it is very limited. Effectively, users and consequently buyers of these arrangements henceforth seek out characters of the most appealing form possible, close to a special type or to a personalized writing.

Patent application EP 0 780 685, in particular in its last embodiment, responds partially to this problem in furnishing an arrangement having a different conception. The first purpose being to improve the design of the characters, the conceivers of such arrangement have started off, no longer from an imposed plan of electrodes, but from the result to be obtained, namely from the letters and numbers themselves, in order to conform the electrodes solely thereafter.

This is why the pixels as obtained are irregularly formed and arranged in a disordered manner without systematic repetition in lines and columns, such pixels having among themselves different contours for the most part.

This type of arrangement ms called a "mosaic" because of its structure of composite aspect formed from numerous pixels having heterogeneous contours (rounded off, rectilinear, in angles . . . ), but complementary and in concordance therewith nesting into one another. It is noted that one does not take into account a logical and uniformly spread distribution of the pixels or electrodes over the entire surface of the arrangement, in contrast to the material structures defined hereinabove. Such type of device is related to the arrangement of pieces of coloured glass which one finds in ancient stained glass windows in religious edifices, in particular in the West.

This arrangement exhibits major difficulties.

Initially, it is noted that in an irremediable manner the fact of stylizing characters leads to increasing the number of pixels which raises the price of the finished and equipped arrangement in a very substantial manner to the extent where it is necessary to associate it with electronic circuits which are more sophisticated and "heavier".

Furthermore, the characters obtained suffer from poor definition and they show, as will be explained hereinafter, defects formed by points.

Effectively, and as is shown very schematically on FIG. 2 of the attached drawings, there appear on the displayed characters such as the "A" shown, points or marks (referenced 10), such defects affecting in particular the aspect and thus the design quality of said characters.

Furthermore, "noise" lines such as that referenced on FIG. 2, appear at the side of, indeed within the characters.

Effectively, each elementary pattern being constituted by an electrode which is electrically insulated from the neighbouring electrodes, it is necessary to couple each pattern to the electronic control system by its own electrical connection.

Such connections are formed by tracks which are structured, as the electrodes, by a photo-lithographic process on a substrate covered by a conductive layer, and they are consequently apt to cause variations of the optical characteristics of the liquid crystal located between them and a portion of the counter-electrode. It is hence understood that such connections may appear on the cell at the same time as the alpha-numeric characters to be displayed, this contributing once again to a deterioration of the quality of the display.

To alleviate this, it has been proposed either to divide into several very fine branches 11*a* each of the connections where they overlap the counter-electrode in a manner to render them invisible (FIG. 2*a*) or to conceive a counter-electrode of extreme complication overlapping only the electrode and not the electrical connections.

In both cases, one obtains arrangements which are complicated to bring into being and as may well be understood, very expensive.

Furthermore, the arrangement according to such application EP 0 180 685, although providing a clear improvement in the form of the characters, remains still very limited since it does not enable visualization of lower case letters. It also shows the essential difficulty of having to be dimensioned as a function of the dimension of the digits and letters to be displayed. This dimension is thus set and may be modified only by changing the arrangement already installed in favour of another of different size.

SUMMARY OF THE INVENTION

Also, the present invention has as purpose to answer to these difficulties in providing a perfected display arrangement capable of visually displaying characters much more stylized for instance close to the character Helvetica Halbfett, of an excellent definition (design), free from defects of the type of those mentioned hereinabove, but in which one may minimize the number of pixels in order to obtain a relatively low manufacturing cost.

The present invention has also as purpose to provide a display arrangement enabling response to the problem of dimensioning the characters at a price likewise the lowest possible.

Thus, the invention has as object an electronic display arrangement of the type comprising:

at least one electro-optical display means, such as for instance a liquid crystal cell, a certain number of elementary patterns associated with said electro-optical display means, such elementary patterns being based for the most part on a series of stylized and selected alpha-numeric characters in the form of a composite mosaic-type structure, the grid of which is formed by the patterns which exhibit heterogeneous and complementary contours arranged so as to nest into one another in a manner similar to that of a puzzle, characterized in that said mosaic is divided up by optically passive bands which partially cover over certain of said elementary patterns and form a cut-up of the mosaic.

According to another characteristic of the invention, said optically passive bands are formed and provided on the mosaic in a position such that such bands are capable of overlapping and masking elementary patterns of smaller surface in order to eliminate them.

It will also be specified that said bands are rectilinear and are all positioned solely perpendicularly or parallel to the sense of reading of the characters on the arrangement.

The invention will be better understood upon reading the detailed description to follow, taken with reference to the attached drawings which are given solely by way of example.

BRIEF DESCRIPTION OF THE DRAWINGS

Referring to FIG. 1, there is shown a liquid crystal cell which forms the active display means of the arrangement according to the invention, such cell 1 comprising, in a known manner, a front plate 2 and a back plate 3 which are transparent and coupled together by A sealing frame 4. The sealing frame 4 defines a sealed volume in which is retained a mixture 5 composed of a liquid crystal and, for instance, of a dichroic colouring material. The front 2 and back 3 plates, which form the substrate, bear on their respective internal faces electrodes 6*a* and a counter-electrode 6*b*, such, which are transparent, being constituted for instance by a mixture of indium oxide/tin. The front 2 and back 3 plates generally bear in the same manner a dielectric layer and an alignment layer which here are not shown.

Furthermore, electrodes 6*a* as well as the counterelectrode 6*b* include electrical connections which are, just as these latter, structured by a photo-lithographic process on plates 2 and 3; such electrical connections, which are not shown here, being respectively coupled to an electronic control circuit, not shown. Furthermore, in this example, cell 1 includes additionally an element 7 of the reflector- diffuser type or transflector, according to the display mode which one wishes.

The functioning of such a cell is presently largely known. It will here simply be detailed that when a potential difference is applied between one of the electrodes 6*a* and the counter-electrode 6*b*, the portion of the liquid crystal located between such electrode and the counter-electrode changes structure so that such portion of the display cell changes its optical characteristic creating a difference of luminosity between the activated and non-activated portions, which produces optically contrasted zones.

As has been previously explained, the known arrangements presently on the market include electrodes 6*a* cut up and arranged in order to be able to display relatively stylish characters.

Figure 1:
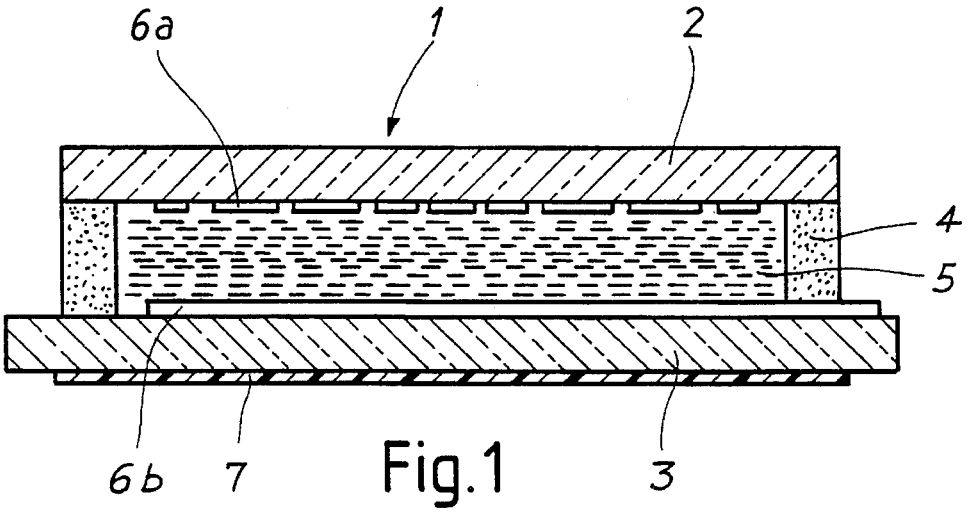
FIG. 1 represents in a schematic manner and in transversal cross-section a liquid crystal cell of a standard type forming by way of example the active display means of the arrangement according to the invention.
Figure 2:
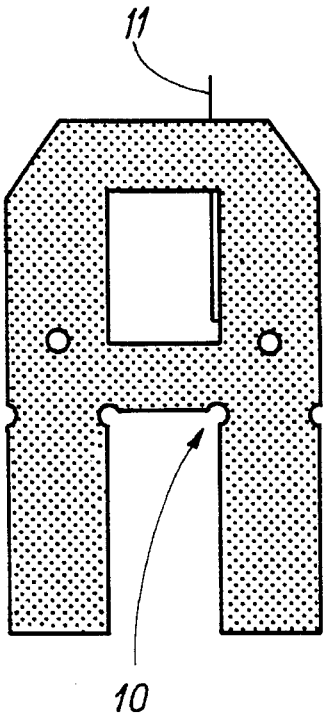
FIG. 2 represents one of the alpha-numeric characters displayed by a prior arrangement, such Figure putting in evidence the defects of this type of character.

At the same time and as shown in a very schematic manner by FIG. 2, certain of the alpha-numeric characters displayed via such arrangements exhibit defects referenced 10. Such defects show up under the form of points or marks at the location of which the cell seems not to be activated, the displayed character having the appearance of being "swallowed" at places.

It is thus understood that such type of difficulty gives rise to a particularly unfavourable effect, detrimental to the commercial attractiveness of the arrangement when it is known that such type of arrangement is intended to permit the display ( for instance of destinations ) in public places such as the halls of railway stations or airports.

Such type of defect gives the illusion that premature wear has occurred and gives numerous users the impression of poor quality.

Figure 2A:
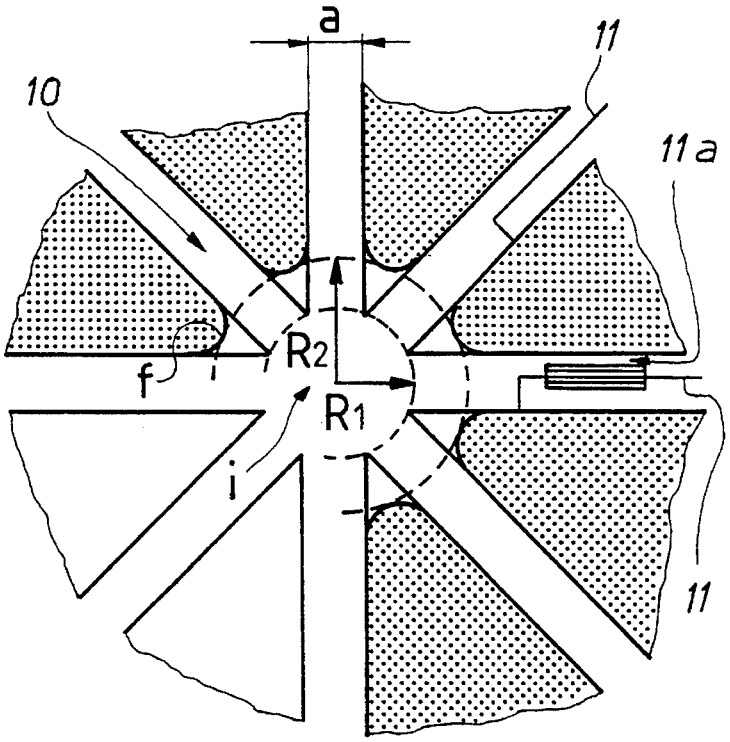
FIG. 2A is a much enlarged view of the arrangement of the elementary patterns, taken at the place of the defect 10 on FIG. 2.

Furthermore, generally there is seen to appear beside or within the display characters strokes which are relatively fine, which are visible when one approaches the display arrangement, such strokes corresponding to the electrical connections referenced 11 on FIG. 2*a*.

To avoid the appearance of such strokes, one technique consists in cutting up the counter-electrode 6*b* in a special manner in order that no portion of such counter-electrode faces an electrical connection 11. However, each elementary pattern having its own electrical connection which emerges in the free space left on the substrate between such pattern and the neighbouring pattern, it is readily understood that the conception of the counter-electrode 6*b* will be that much more complicated and that such latter is consequently that much more expensive.

As shown on FIG. 2*a*, another solution consists in dividing each connection 11 into several branches 11*a* such branches, which are finer, being consequently much less visible, at least from a certain distance.

Here again, it is understood that the obtaining by photolithography of such branches complicates considerably the manufacture of the display means and additionally does not permit a reduction of the cost of the cells.

Figure 3:
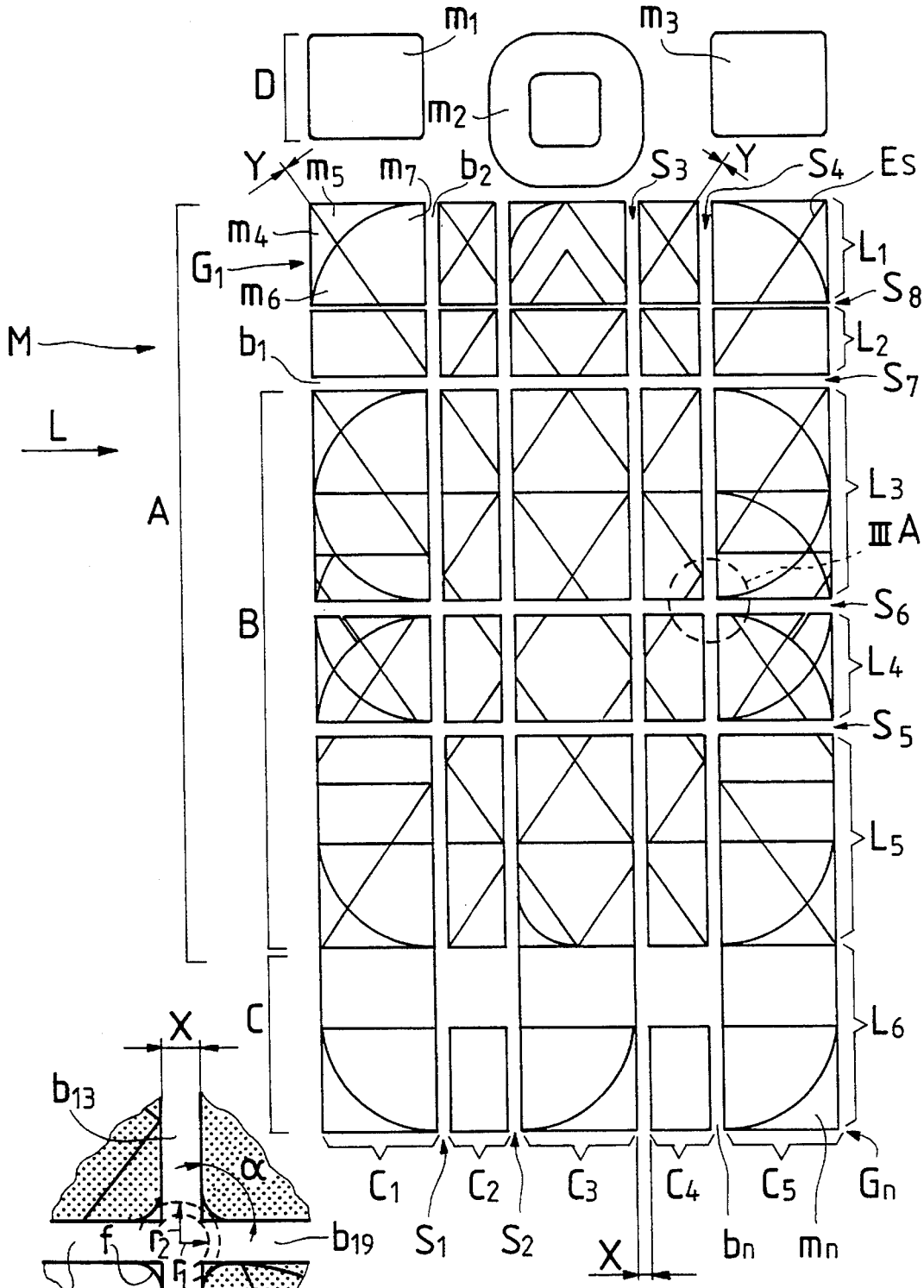
FIG. 3 is a top view of a mosaic according to a first embodiment intended to equip the display arrangement according to the invention, the patterns of this mosaic being in such example constituted by electrodes of a cell such as that shown on FIG. 1.
Figure 6:
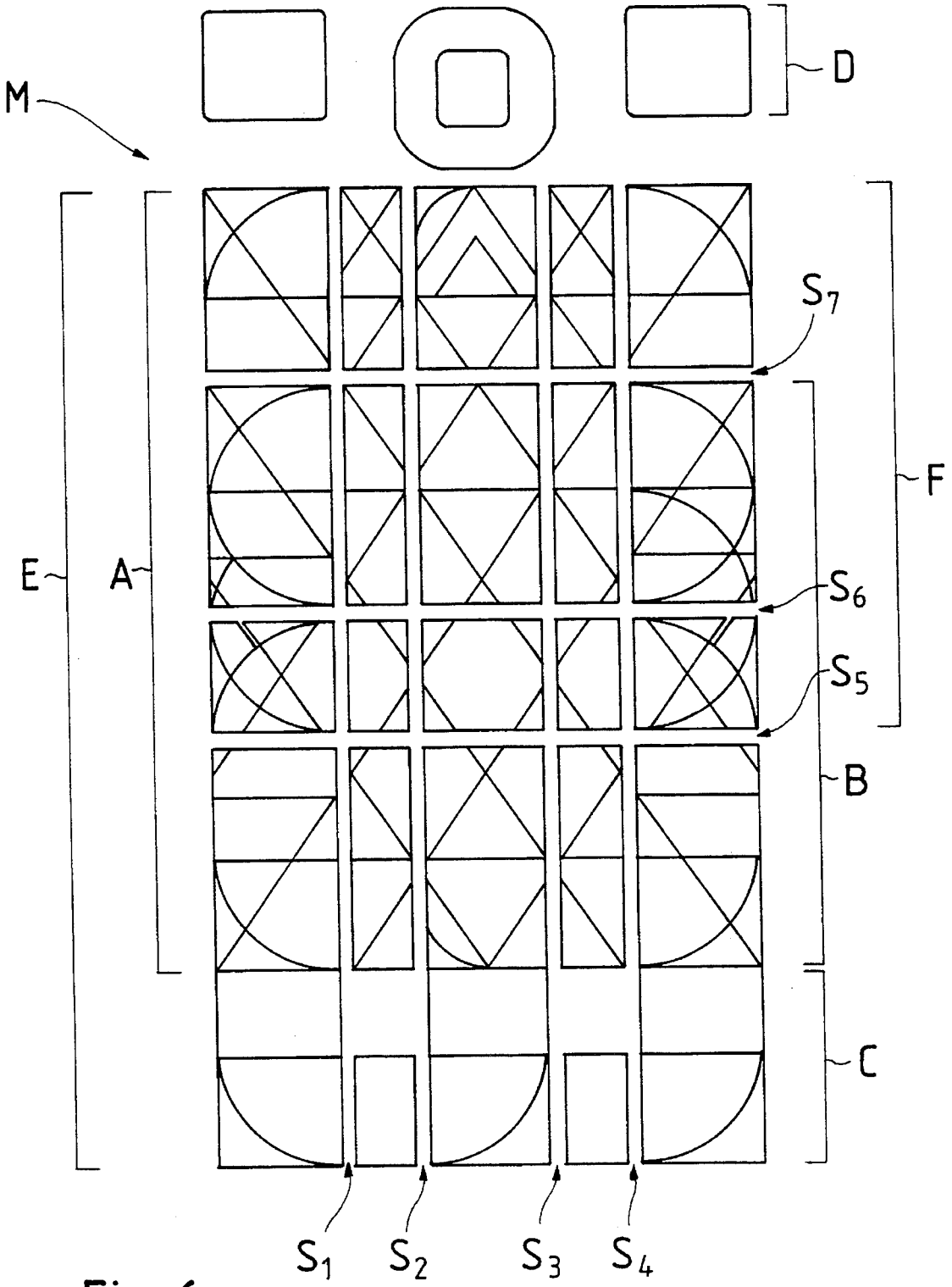
FIG. 6 is a top view of a mosaic according to a second embodiment of the invention.

On FIGS. 3 and 6, there is shown a top view of the two embodiments of the mosaic according to the invention, the patterns of such mosaic which are generally called "pixels" being constituted in this case by the electrodes 6*a*. In analogous manner, such patterns may be constituted by electro-luminescent diodes arranged on an appropriate support, or by any other display means which may be electrically activated.

The layout of the elementary patterns in pixels according to the invention responds well to the definition of a mosaic and in particular of a composite mosaic since it will be noted that such patterns present heterogeneous and complementary contours, namely rounded, rectilinear or oblique contours with indiscriminate combinations, such patterns being arranged in a manner to nest into one another in a manner similar to that of a puzzle. It is noted that all such patterns are arranged in an irregular and unordered manner without any systematic repetition of lines or columns in one direction or another.

The elementary patterns $m_1$ to $m_n$ of the mosaics of FIGS. 3 and 6 (of which not all have been referenced) are conformed and associated among themselves in a manner such that the arrangement according to the invention may display an entire range of alpha-numeric characters such as the letters of the Latin alphabet in capitals and lower case, certain letters employed in European languages such as Germanic or Nordic languages, as well as the digits 0 to 9, all of such characters being capable of association with their respective accentuation including underlinings. Advantageously, each mosaic of both these embodiments is shaped in order to be capable of displaying characters close to the style "Helvetica Halbfett".

Furthermore, the mosaic M of elementary patterns $m_{1-n}$ ($m_1$ to $m_N$) enables displaying all the punctuation signs in order that the combination of several mosaics M among themselves juxtaposed side by side or superposed in modules enables the display of intelligible messages constituted in the form of structured sentences or in the form of groups of coded words.

It will be noted that thanks to a dividing up of such mosaic (operation to be explained hereinafter), certain of the elementary patterns $m_{1-n}$ are located assembled groups $G_1$ to $G_n$, such elementary patterns in each group being coupled in a manner very close, at the limit of juxtaposition, a very small spread Y being left among them.

The groups of patterns $G_{1-n}$ ($G_1$ to $G_n$) are arranged in lines $L_1$ to $L_6$ and in columns C1 to C5. The isolated elementary patterns $m_1$, $m_2$ and $m_3$ enable the accentuation of Germanic and Nordic characters. The elementary patterns $m_1$ and $m_3$ are aligned and are respectively provided in the prolongation of columns C1 and C5. The elementary pattern $m_2$ which has the aspect of a substantially rectangular ring is arranged substantially below the elementary patterns $m_1$ and $m_3$ and facing the central column C3.

Lines $L_1$ to $L_6$ of the groups $G_1$ to $G_n$ bound at least three characteristic zones, respectively A, B and C, a last zone D forming the above-mentioned accentuations.

Zone A is the visualization .or materialization zone of a first dimension of capitals, while zone B is the zone visualization of the lower case letters. As to zone C, this is the zone enabling in particular the display of the end of the downstrokes and the display of underlinings, zones A, B and C each counting five suitably aligned columns.

Figure 4A:
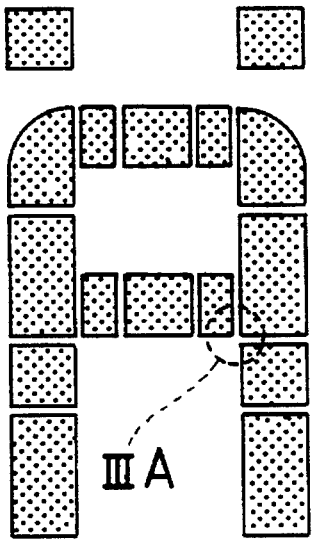
FIGS. 4A to 4K show respectively certain of the alpha-numeric characters capable of being displayed by means of the mosaic according to the first embodiment.
Figure 4B:
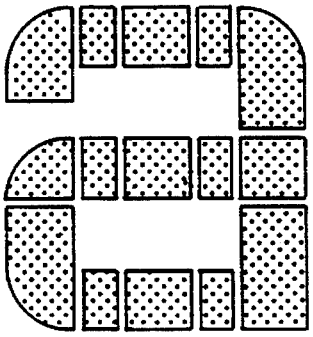
Figure 4C:
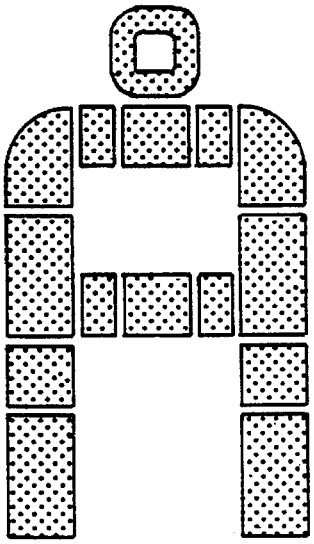
Figure 4D:
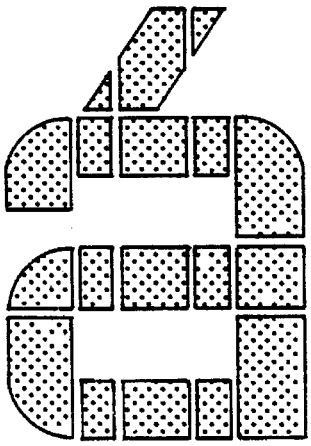
Figure 4E:
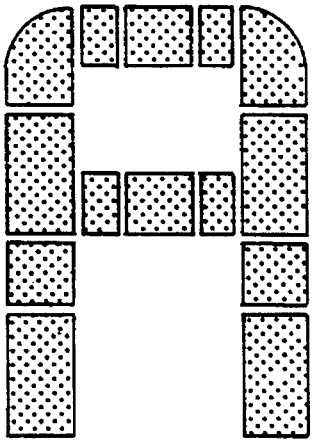
Figure 4F:
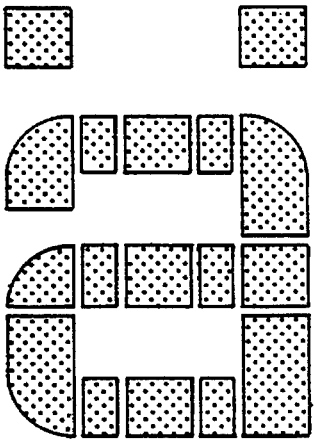
Figure 4G:
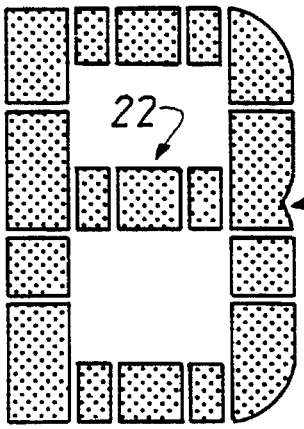
Figure 4H:
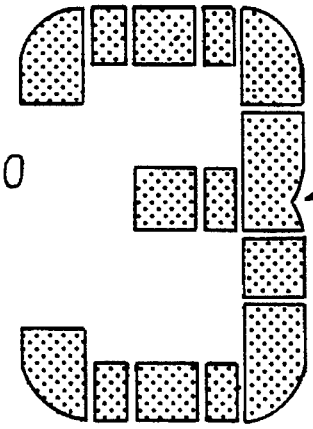
Figure 4I:
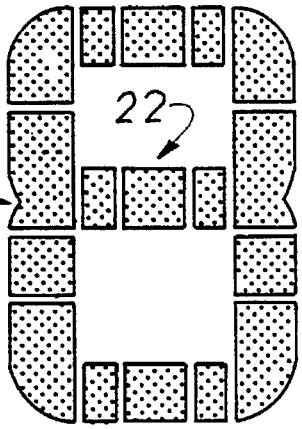
Figure 4J:
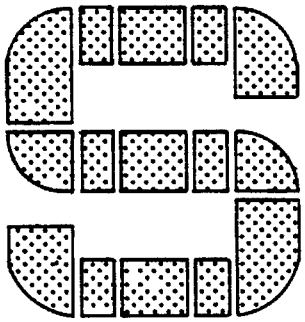
Figure 4K:
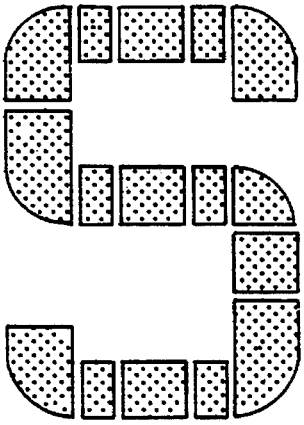

Zones A and B advantageously include in the first embodiment of FIG. 3, respectively five and three lines of characteristic groups, such choice of odd numbers of lines enabling the display of letters or digits such as "B", "3" or "8", the grooved portions 20 of which are centered relative to a horizontal cross bar 22 as specifically shown on FIGS. 4G to 4I.

Furthermore, the fact of having available an odd number of lines in zone A for the capitals and in zone B for the lower case letters enables displaying capitals and lower case letters substantially centered, such as has been shown on FIGS. 4B, 4D, 4F and 4G to 4K. This special characteristic of the arrangement of the groups $G_1$ to $G_n$ relative to one another enables thus the visualization of balanced characters having a design aspect completely satisfactory.

Furthermore, in each of the distinct and characteristic groups $G_{1-n}$, the spread Y which separates each elementary pattern (for instance the pattern $m_4$) from the adjacent pattern or patterns, in such case patterns $m_5$ to $m_7$, is slight, that is to say, on the order of $10\times10^{-6}$ meters (10 μm) to $50\times10^{-6}$ meters (50 μm). Such distance has as its essential function to insulate electrically the neighbouring patterns and it forms on the mosaic the width of the insulating spaces Es which separate the patterns among themselves. The patterns in each group are thus arranged relative to one another in a very close manner and seem, even at a slight distance, connected side by side to one another. As one may observe on the letters and the digits of FIGS. 4A to 4K, such spread distance Y does not appear in the displayed characters.

One may define each group $G_{1-n}$ as being formed by at least two elementary patterns connected in an adjacent manner and separated from one another at least partially by an insulation space Es.

Preferably, the spread distance Y is chosen to be the smallest possible taking into account practicability conditions and the chosen yield.

In the preferred embodiment of the invention shown on FIG. 3, each group of patterns, at least in zones A and B, includes a separation gap in rectilinear form.

Additionally, each characteristic group $G_1$ to $G_n$ is separated from the neighbouring group or groups by separation bands $b_{1-n}$ ($b_1$ to $b_n$), each separation band being in fact provided, in the case of a liquid crystal cell, by the absence of a conductive layer on the substrate between the electrodes *6a* of the neighbouring groups; such substrate being constituted by plate 2.

The separation bands $b_1$ to $b_n$ have preferably all the same width X, such width being preferably on the order of $1.2\times10^{-3}$ meters (1.2 mm). Typically, it is chosen equal to $1.5\times10^{-3}$ meters (1.5 mm).

It is noted that the value X, that is to say the width of the separation bands which form the different characteristic groups $G_1$ to $G_n$, is in any case clearly greater than the value Y which is the width of the gap or insulation space Es left between the adjacent elementary patterns within a same group. In the present case, the value X is chosen to be from 25 to 120 times greater than the value Y.

It has been estimated that the value R which is the ratio R between the value X and the value Y (R=X/Y) gives satisfactory results when R is at least greater than 15, in other words when the width of the separation bands is 15 times greater than the separation distance Y left between the patterns.

Preferably, the value R is chosen equal to 30, in which $X=1.5\times10^{-3}$ meters (1.5 mm) and where Y is equal to $50\times10^{-6}$ meters (50 μm). To this end, it will be specified that preferably the separation distance Y is chosen less than $100\times10^{-6}$ meters (100 μm).

Generally, in the embodiment of FIGS. 3 and 6, the mosaic according to the invention exhibits a divided structure such that the separation bands arranged between two adjacent groups always show a width X which is greater than the separation distance Y left between the patterns of such groups.

Furthermore, in this embodiment, all the elementary patterns whether in zone A or in zone B, are organized in groups, namely connected two by two, at least in part to the limit of side-by-side connection. In the present case, the mosaic including 152 elementary patterns, only five among them being isolated, one may determine that in the entire mosaic about 97% of the elementary patterns are organized in groups.

This choice of group organization has, as is well understood, important functional consequences, but also provides to the mosaic M, namely the display arrangement, the possibility of displaying characters of a completely special style, such as those shown on FIGS. 4A to 4K. The separation bands $b_1$ to $b_n$ constitute optically passive regions and form, between the groups $G_1$ to $G_n$, preferred passages for the electrical connection elements 30, from the elementary patterns $m_{1-n}$ towards the periphery of the display means, as is shown on FIG. *3b*.

Figure 5:
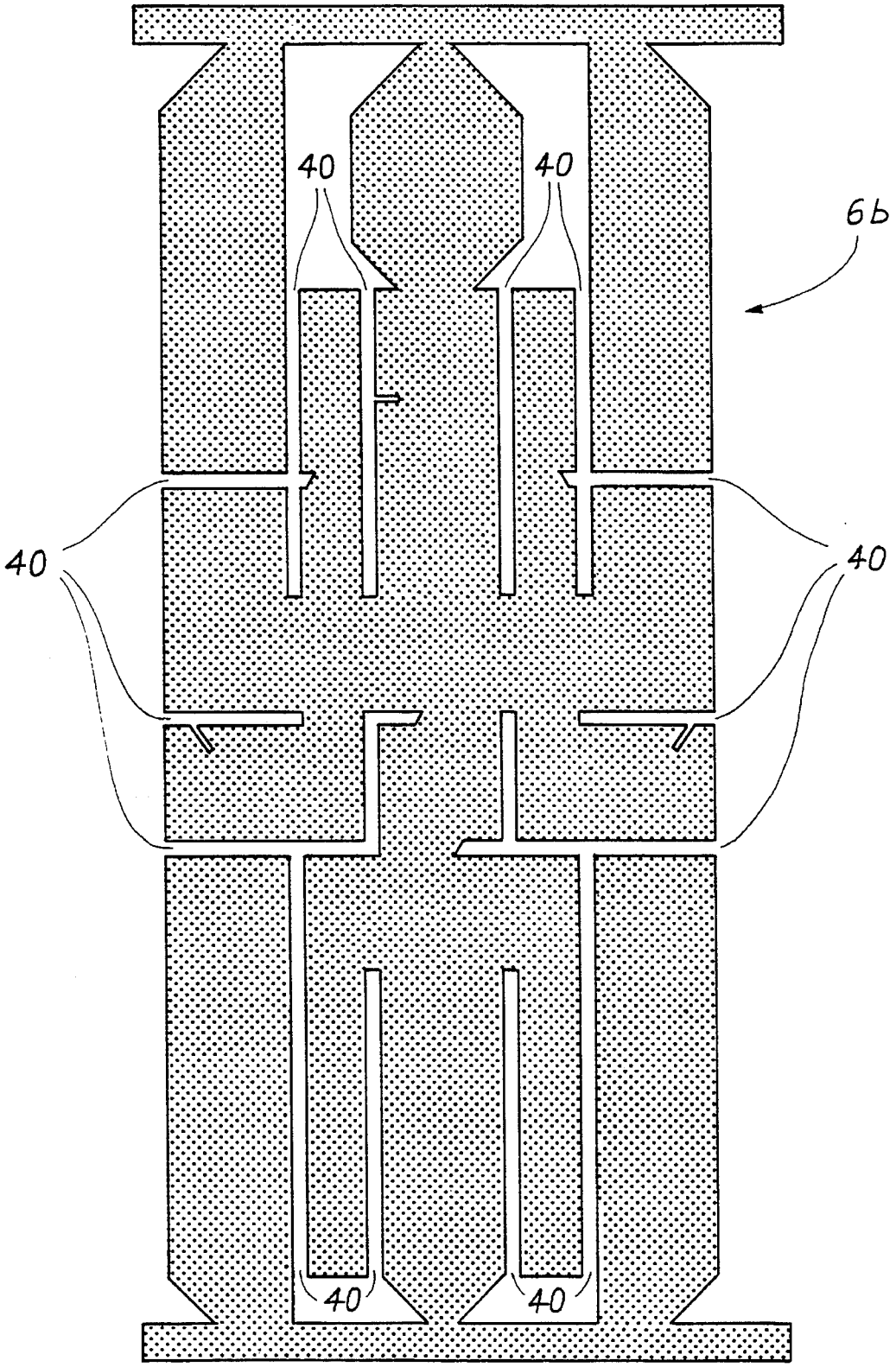
FIG. 5 shows a top view of a counter-electrode according to the invention.

Such separation bands $b_{1-n}$ form free zones clearly bounded as appears very clearly on FIG. 3 in a manner such that it is quite easy to form in a corresponding manner the counter-electrode *6b* shown on FIG. 5, such counter-electrode *6b* being conformed in a manner such that its "cut-out" zone 40, which correspond to the absence of a conductive coating, are arranged facing the separation bands in which are arranged the electrical connections. Thus, it is understood that these regions are optically passive, and that thee electrical connections 30 do not appear on the display arrangement during the visualization of alpha-numeric characters.

Furthermore, the mosaic M, namely the arrangement of the different elementary patterns $m_{1-n}$ among themselves is provided in a manner such that at the most four separation bands $b_{1-n}$ intersect on or within the active display means. The separation bands $b_{1-n}$, at least at the level of the point of intersection I (FIG. 3A), are angularly separated from one another by an angle α greater than 60°.

The value of this angle α corresponds to that from which the appearance of defects such as will be defined hereinafter, begins to diminish in a noteworthy manner.

Preferably, the angle α is at the most equal to 90°. It may be specified also that in the preferred embodiment, the exterior contour of each group of patterns $G_{1-n}$ is substantially rectilinear, such contour being preferably substantially rectangular.

The bands $b_{1-n}$ are in fact formed by continuous or cut separations $S_1$ to $S_n$, which are formed over the major part of the display means, such continuous separations $S_1$ to $S_n$ crossing the mosaic M from end to end to open out from its respective right and left lateral edges, and from its upper and lower edges. This is particularly true for zones A, B and C for the vertical separations $S_1$ to $S_4$ and in the zones A and B for the horizontal separations $S_5$ to $S_8$.

However it may be, throughout the entire mosaic, the separation bands $b_1$ to $b_n$ and the continuous or cut separations $S_1$ to $S_n$ are organized perpendicularly or parallel relative to the reading sense L of the characters on the mosaic.

Referring to rectilinear or horizontal reading, one may specify that the continuous or cut separations $S_1$ to $S_7$ and the separation bands which they form, may be defined as being oriented in directions essentially vertical and horizontal.

The display arrangement according to the invention, in particular enables elimination of defects such as the points or marks 10 which appear on characters displayed by arrangements presently known. Reference will be made now to FIG. 2A, which represents in a detailed manner the arrangement of the elementary patterns of a known display arrangement.

The appearance of defects 10 on such a layout may be explained by the combination of several phenomena.

Initially, at a small distance relative to the display arrangement, the defects may be geometrically represented as an arc of a circle or a circle of radius R1, the circle being tangent to the ends or points of the different elementary patterns which converge towards the intersection point i. In the present case, it is observed that the radius R1 is already greater than the separation distance a left between the different elementary patterns. Thus, even at a short distance, defect 10 appears as being already predominant relative to the intervals left between the patterns. Such defect in addition to such intervals, appear in the same optical mode which is different from that of the displayed characters, that is to say, in a contrasted manner relative to such characters.

At a greater distance, there occurs at the ends or converging points of the different elementary patterns an optical "erosion" phenomenon, that is to say, loss of definition, the eye having a tendency to no longer discern such points, but to see rounded edges f.

Thus, the defect 10 at this distance increases considerably to be materialized under the form of a circle of radius R2, such radius R2 being very clearly greater than the radius R1 of the defect which is visible at a short distance.

Thus, at a greater distance, the spread between the gap a and radius R of the defect 10 increases to the extent that such defect 10 henceforth appears as being very preponderant relative to the mentioned gap a.

Figure 3A:
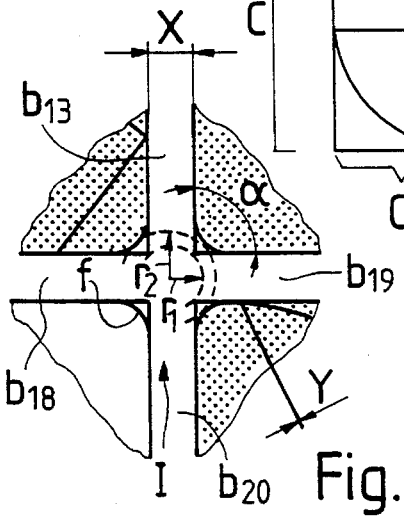
FIG. 3A is an enlarged view of region IIIA of FIG. 3.
Figure 3B:
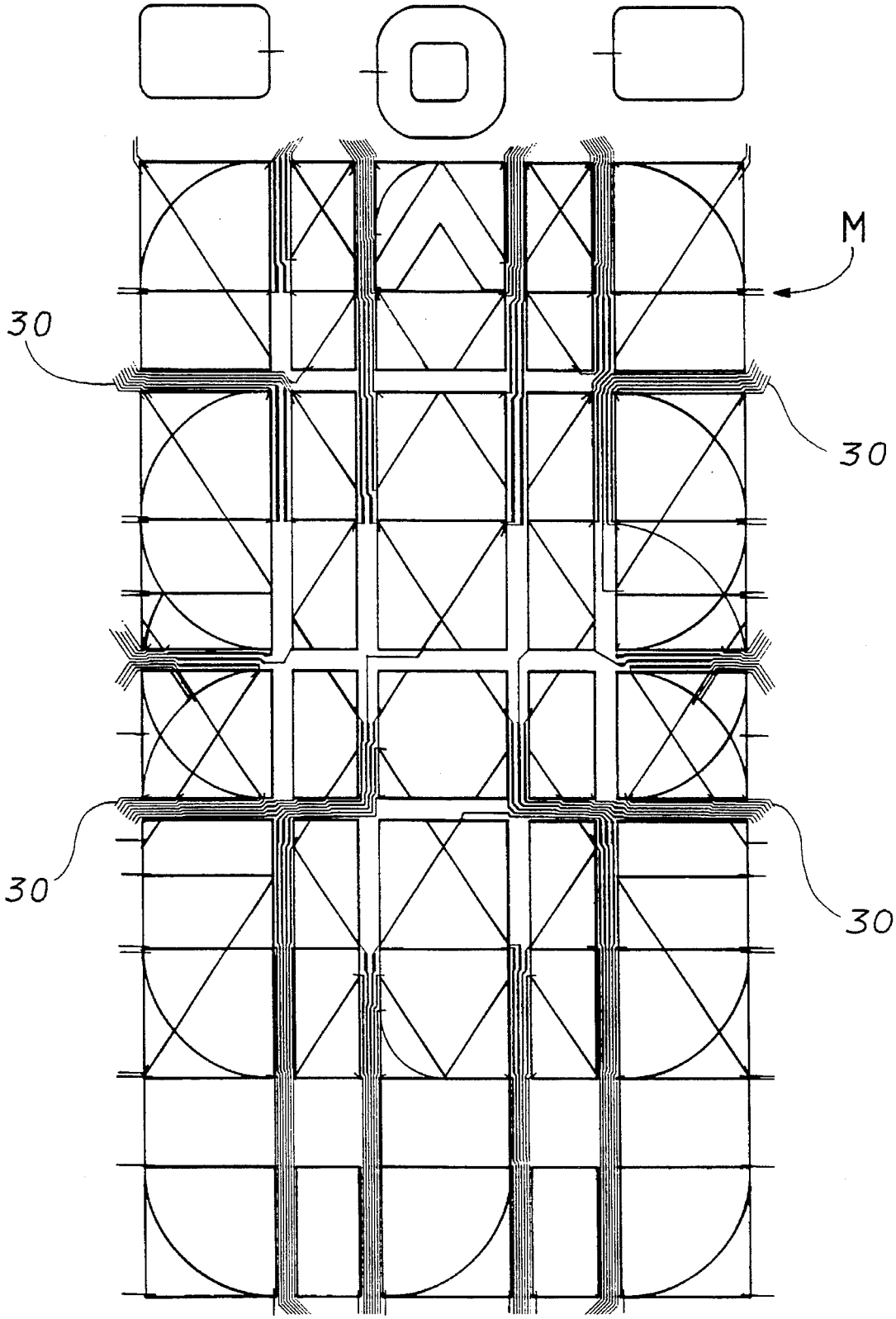
FIG. 3B is a view similar to FIG. 3 but represents different elementary patterns of the mosaic associated with their electrical connection.

Contrary thereto, in the configuration of the mosaic according to the invention, there is observed as shown by FIG. 3A that at a short distance the envelope circle from the point of intersection I to the level of the separation bands, for instance b13, b18, b19 and b20, exhibits a radius $r_1$ of a value less than the width X of the separation bands $b_{13,18,19,20}$.

Thus, the envelope circle does not appear at a short distance and no longer forms a defect since it is no longer preponderant relative to the width of the separation bands $b_{1-n}$.

Moreover, at a great distance, the optical "erosion" becomes less important since for a same arc of circle f, such arc f tends to come considerably closer to the points or ends of the groups $G_{1-n}$.

Thus, the envelope circle of the intersection point I exhibits a radius $r_2$ having a value substantially equal to the width X of the separation bands $b_{1-n}$. There appears thus practically no defect in the alpha-numeric characters displayed with such a configuration, whether this be at a small or a substantial distance.

Furthermore, it has been observed that the definition of the characters and the readability are improved when the separation bands $b_{1-n}$ and more particularly the continuous or divided separations $S_1$ to $S_n$ which form the division of the mosaic are oriented parallel and/or perpendicular to the reading sense of the displayed characters, the mosaic M being oriented on an entire panel display assembly in the sense in which it is represented on FIG. 3, namely vertically.

It has also been observed that this arrangement improves the appearance of the displayed characters.

There will be further specified here that such mosaic M offers, thanks to its configuration, an appreciable aesthetic characteristic in that the elements for accenting lower case letters (see FIGS. 4D to 4F) are arranged in the zone A of visualization or materialization of the capitals. Thus, the accentuation elements of the lower case letters are practically joined to such letters as such is moreover provided in different alphabets, such as the Latin alphabet. Once again, such possibility is explained by the arrangement in groups of the elementary patterns. Since the addition of supplementary elementary patterns at the center of a same group is rendered possible thanks to the arrangement quasi connected of the elementary patterns in such group, the accentuation elements are not distinguishable in the body of a capital alpha-numeric character which employs such group in order to be visualized such as is shown by the characters of FIGS. 4D to 4F.

Furthermore, there will be also specified that the separation bands $b_{1-n}$ and thus the continuous or cut separations $S_1$ to $S_n$ are arranged in a manner such that their intersection points I are found outside the materialization regions of the branches of the characters which appear vertically or horizontally.

Referring thenceforth to FIG. 6, there is seen a composite display mosaic according to a second embodiment of the invention.

The mosaic according to this embodiment includes four continuous or cut vertical separations oriented perpendicularly to the reading sense L, as well as three continuous or cut separations S5 to S7 oriented parallel to the reading sense L, that is to say, defined as being horizontal. In this embodiment, the seven continuous or divided separations which form the division of the mosaic M have a width X of a value equal to those mentioned hereinabove.

In referring henceforth to FIGS. 7 to 10, there will be explained by which procedure the grids of the mosaics of FIGS. 3 to 6 have been produced and how the division of such mosaic into bands has been brought about, that is to say, in optically passive separations or cuts.

Figure 7:
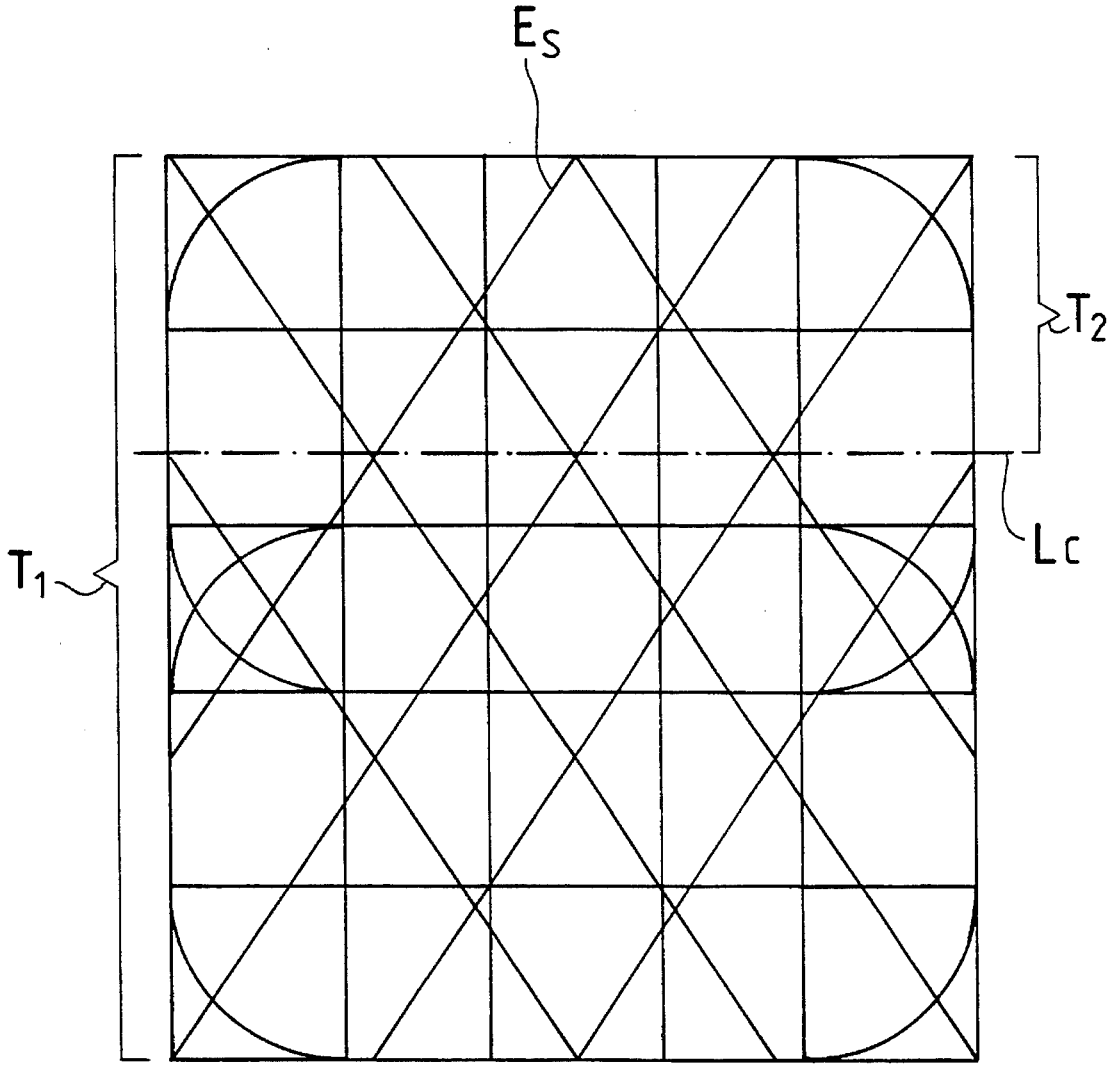
FIG. 7 is a top view of a base grid intended to form a mosaic such as shown on FIGS. 3 and 6 and corresponding to the first stage of obtaining such mosaic.

Referring thus henceforth to FIG. 7, there has been represented a grid having a base $T_1$ referred to as the first grid which constitutes the starting structure of the mosaic according to the invention. Such base grid $T_1$ is intended to form the zone B which permits display of lower case letters as well as the display of a first set of small digits.

Figure 8:
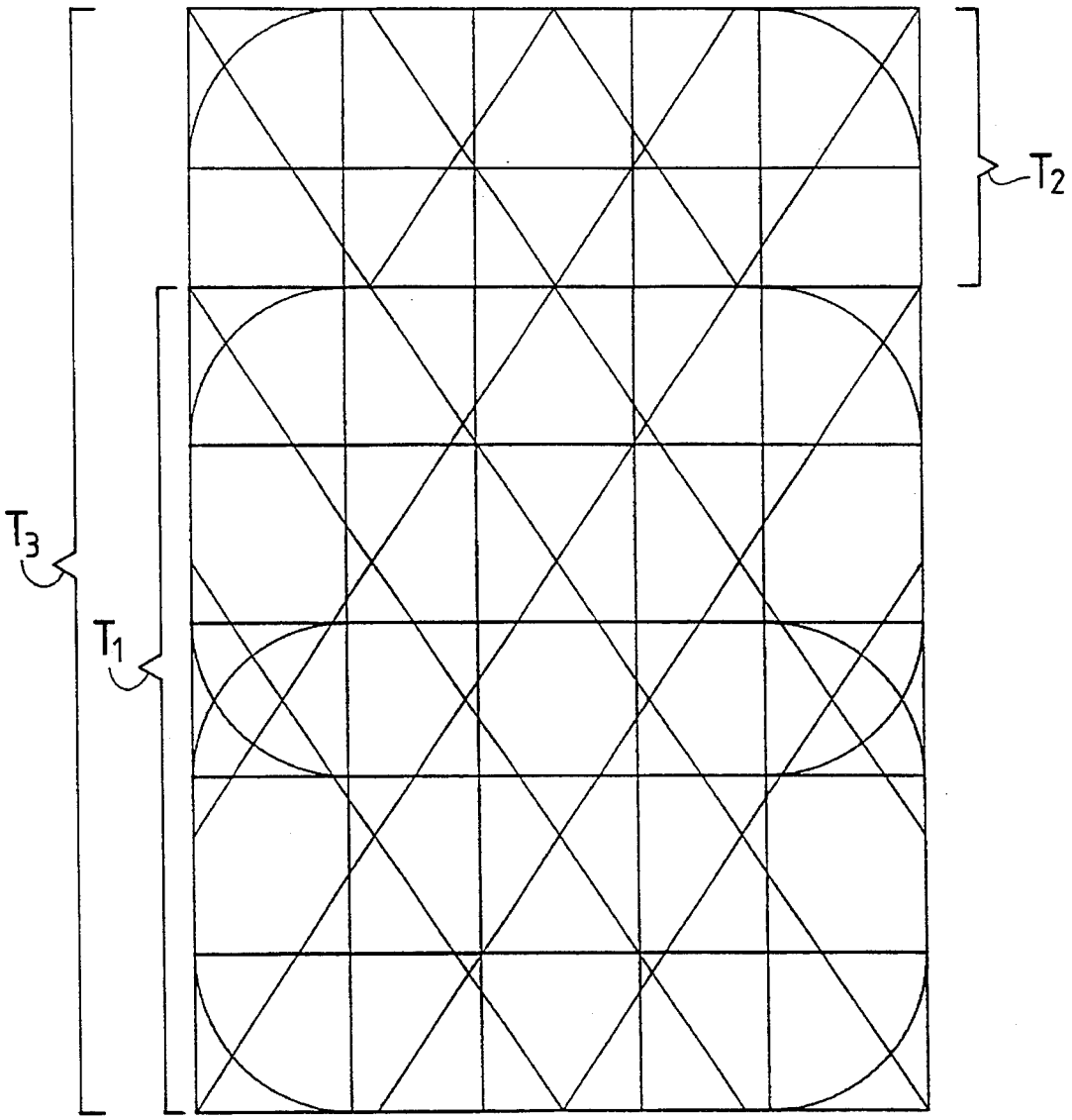
FIG. 8 is a top view of a second stage of manufacture of said mosaic, including the base grid of FIG. 7 associated with an additional grid.

Very advantageously and as is seen on FIG. 8, such base grid $T_1$ has been partially reproduced, in particular there has been reproduced its upper portion referenced $T_2$. The line in mixed dashes $L_c$ represents the upper portion of the base grid $T_1$ which has been reproduced, then "glued" above the base grid $T_1$. There will be specified that the dividing line $L_c$, in order to duplicate the base grid, has been positioned in a manner such that after joining the two grids $T_1$ and $T_2$, the oblique insulation spaces come into concordance which permits eventually the display of characters of different dimensions, at the interior of one and the same mosaic. To this end, the dividing line $L_c$ has been positioned at the intersection of the insulation space Es oriented in an oblique manner.

After having obtained such duplicated structure of the base grid, in particular after having obtained an additional grid referred to as the second grid $T_2$ which is arranged above the first $T_1$, one proceeds to divide the resulting grid $T_3$ by continuous or cut separations $S_1$ to $S_n$, arranged in the orientation as has been explained hereinabove. As is seen on FIG. 9, the continuous or cut separations then compartmentalize entirely the resulting grid $T_3$ since they traverse the major portion of the mosaic according to the invention, and thus form different groups of elementary patterns within the mosaic. As is seen on FIG. 9 and in comparison with FIG. 8, the separations or cuts $S_1$ to $S_7$ partially cover certain elementary patterns of the grid $T_3$. Additionally, such Optically passive separations or cuts are arranged in a manner such that they come to overlap and mask entirely elementary patterns of the smallest surfaces, which have been blackened on FIG. 9 for a better representation of the designs. Since such separations in bands or cuts $S_1$ to $S_7$ are optically passive and correspond to an absence of electrode surface, the elementary patterns of smallest surface are eliminated and no longer need to be associated with an addressing means which causes problems as much on the electronic level as on the level of electrical connections.

Advantageously, the mosaic according to the invention includes at least two separations or horizontal cuts referenced $S_5$ and $S_6$ and which are very advantageously arranged neighbouring the zones in which the density of the elementary patterns is greatest. Such zones are respectively referenced 100 and 120. Preferably, such separations or cuts $S_5$ and $S_6$ are located in a manner tangent to such zones 100 and 120 of great density of elementary patterns.

Thus, it becomes much easier to supply elementary patterns to the pixels which are difficult of access and to which it is necessary to couple an electrical connection. It will be noted that the two horizontal separations or cuts $S_5$ and $S_6$ are arranged on either side of a line of groups of pixels $L_4$ which is intended to form, as will be seen on the following Figures, an intermediate horizontal bar for the formation of lower case letters. More precisely, such separations or cuts $S_5$ and $S_6$ are arranged in a manner tangent to such line $L_4$ and to such intermediate bar.

Additionally, such mosaic includes thus a third horizontal separation or cut $S_7$ which is arranged in a manner tangent to the line $L_3$ which forms the group of patterns intended to display in particular a horizontal bar above the lower case letters. Preferably, such separation or cut $S_7$ is placed directly above the line $L_3$.

As far as concerns henceforth the vertical separation in bands or cuts, it will be specified that at least two among them, namely the separations $S_1$ and $S_4$ are positioned in a tangential manner to regions or columns $C_1$ and $C_5$ of the mosaic which are intended in particular to form downstrokes of letters.

Preferably, the arrangement according to the invention includes four continuous or divided separations which are arranged perpendicularly to the reading sense, such four separations or cuts defining respectively among them the five columns $C_1$ to $C_5$, among which columns $C_1$, $C_3$ and $C_5$ constitute respectively lateral and central columns for formation of downstroke 24. It will be specified that such central $C_3$ lateral $C_1$, $C_5$ columns exhibit equal width. Moreover, such three columns $C_1$, $C_3$ and $C_5$ for forming downstrokes are separated two by two by intermediate columns $C_2$ and $C_4$ which are of equal width between themselves, but of a width less than that of the three columns $C_1$, $C_3$ and $C_5$.

Figure 9:
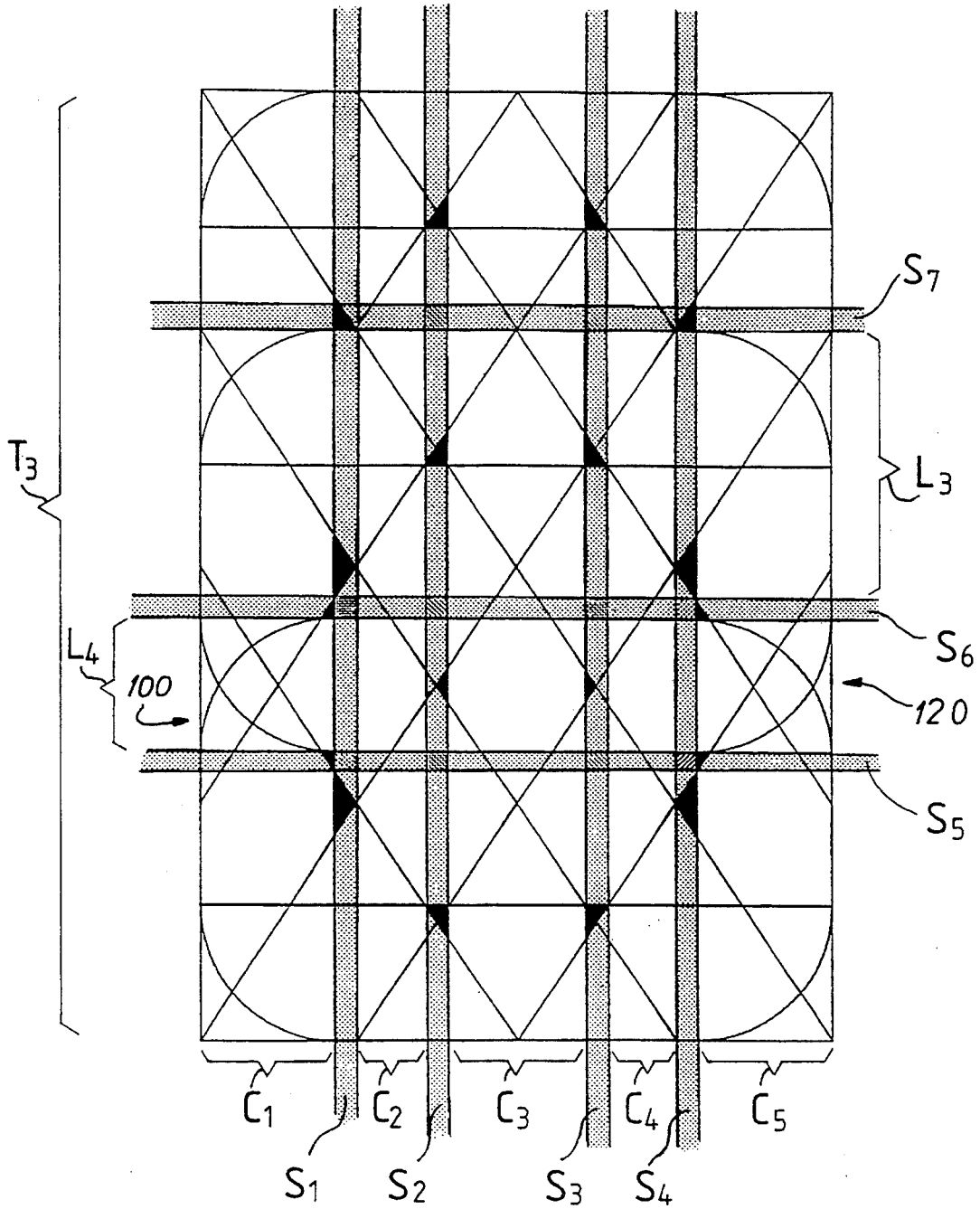
FIG. 9 shows a third stage of manufacture of the mosaic of FIG. 6, in which the blackened regions correspond to continuous or cut-up separations arranged on the mosaic in order to divide it.
Figure 10:
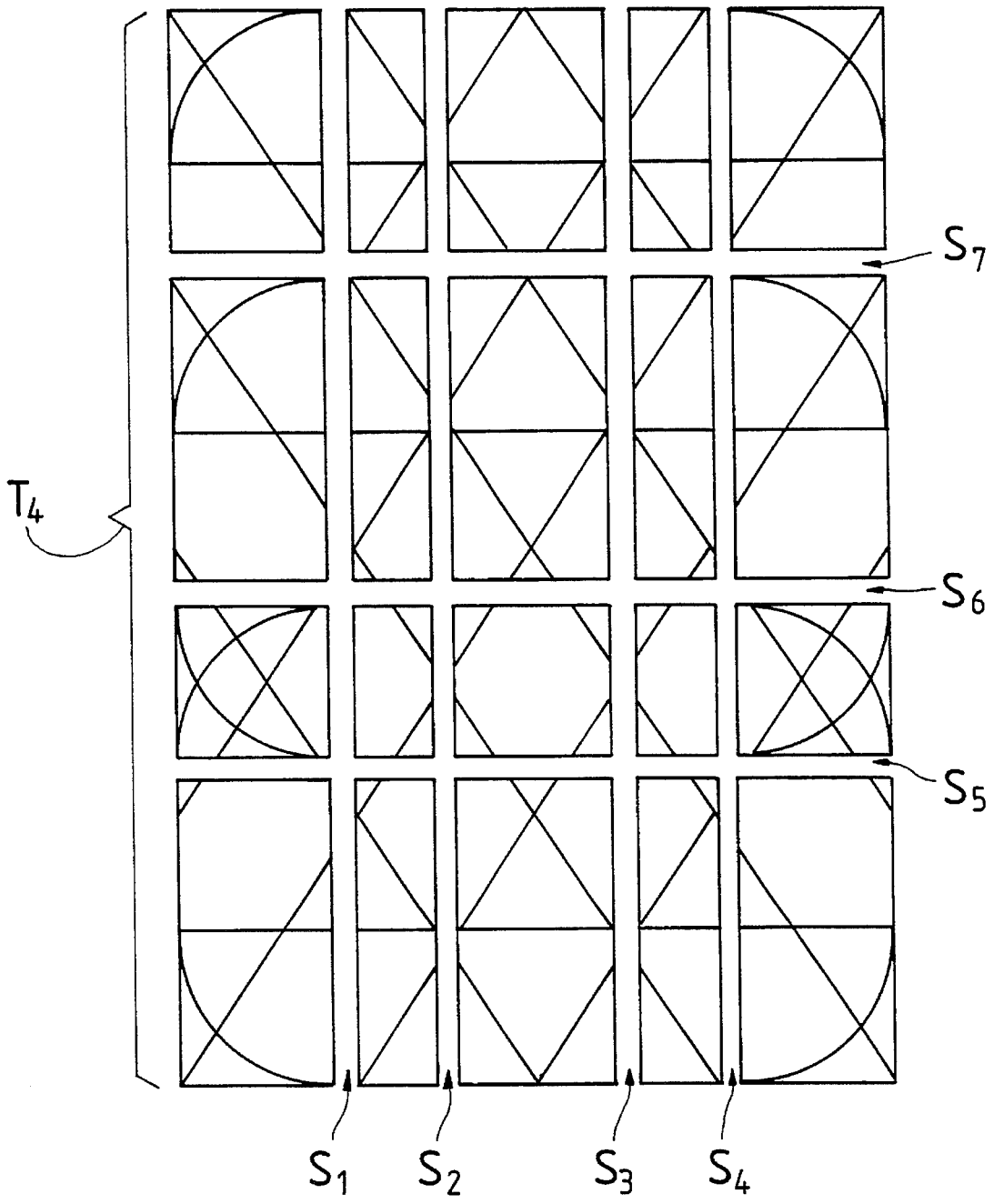
FIG. 10 shows the grid obtained following the stage represented on FIG. 9, and FIGS. 11 to 38 represent the alpha-numeric characters which may be displayed, in particular thanks to the mosaic of FIG. 6.
Figure 11:
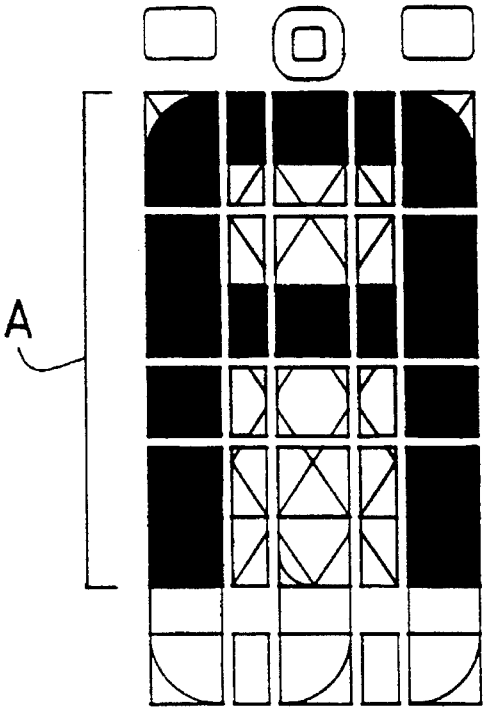
Figure 12:
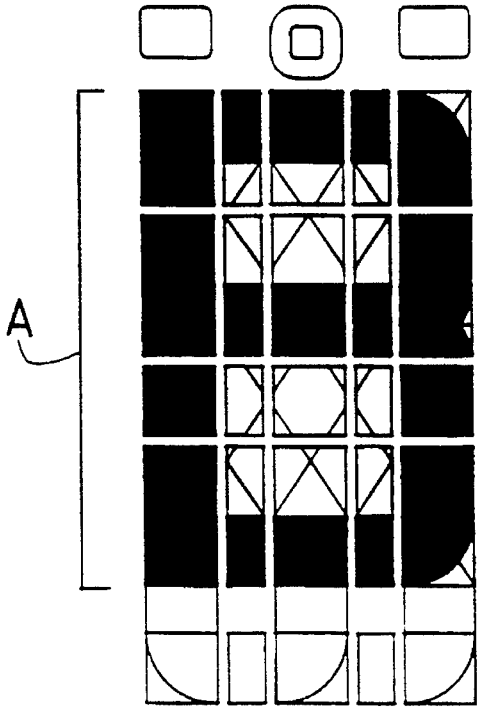
Figure 13:
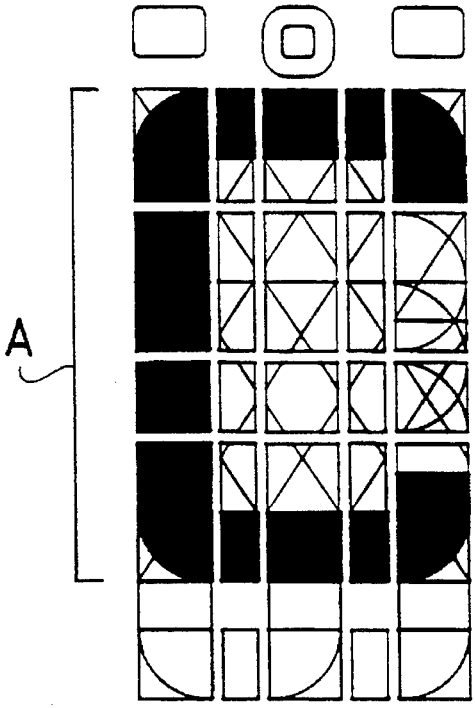
Figure 14:
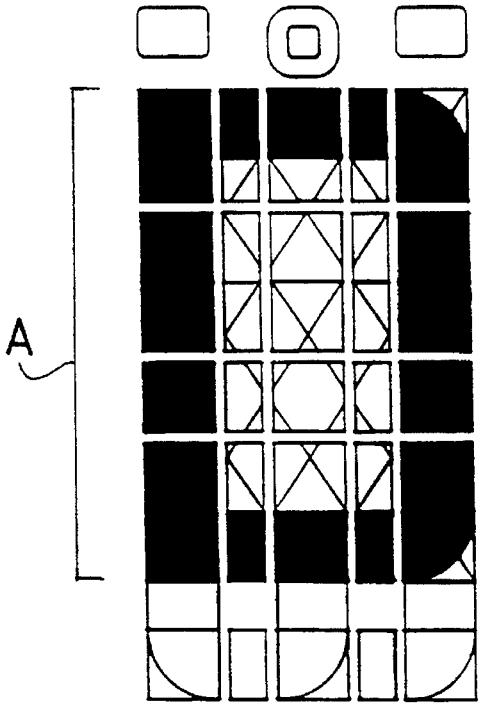
Figure 15:
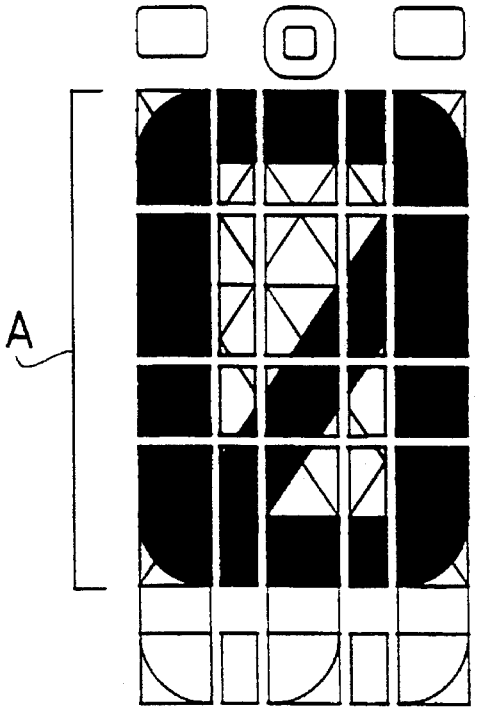
Figure 16:
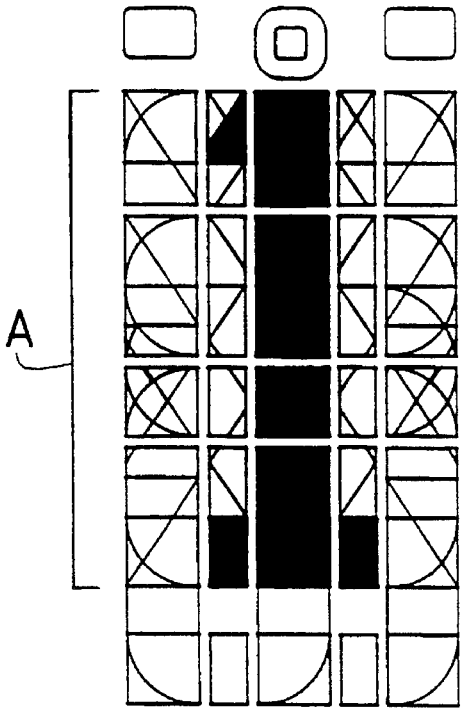
Figure 17:
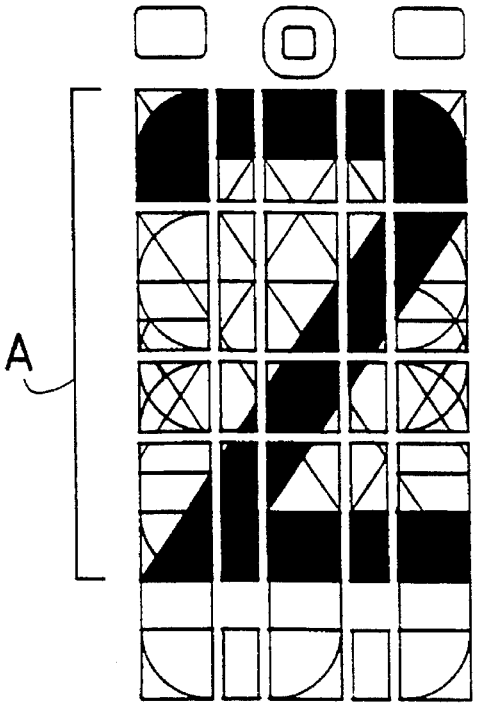
Figure 18:
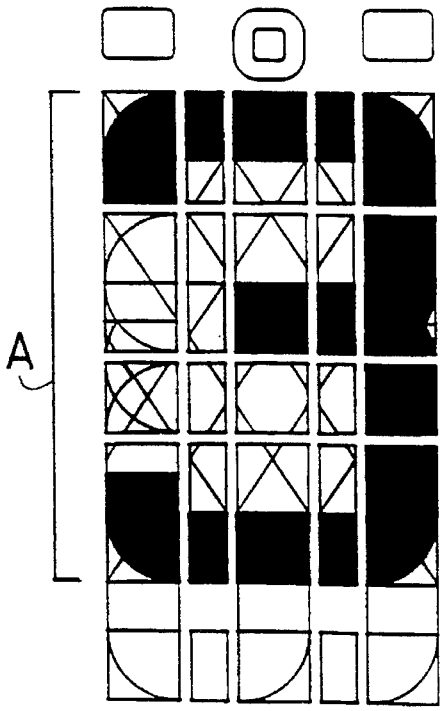
Figure 19:
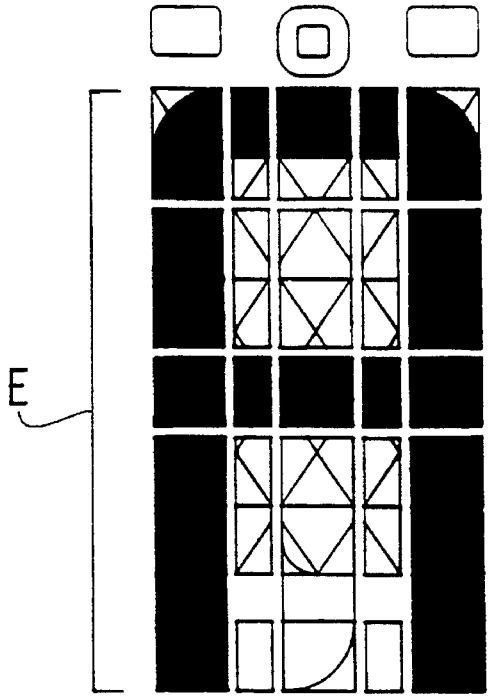
Figure 20:
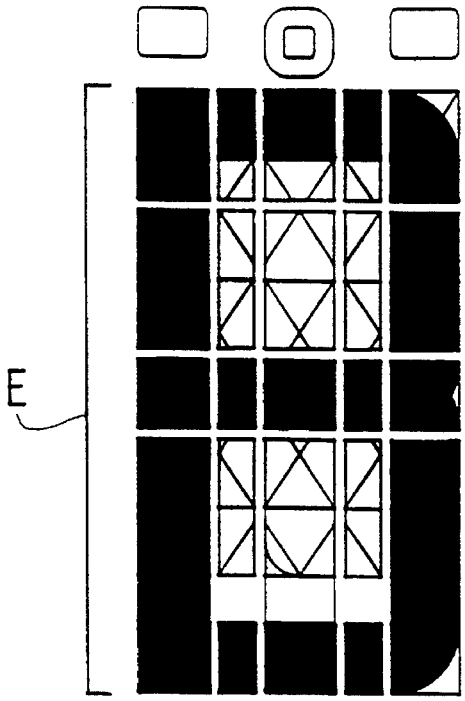
Figure 21:
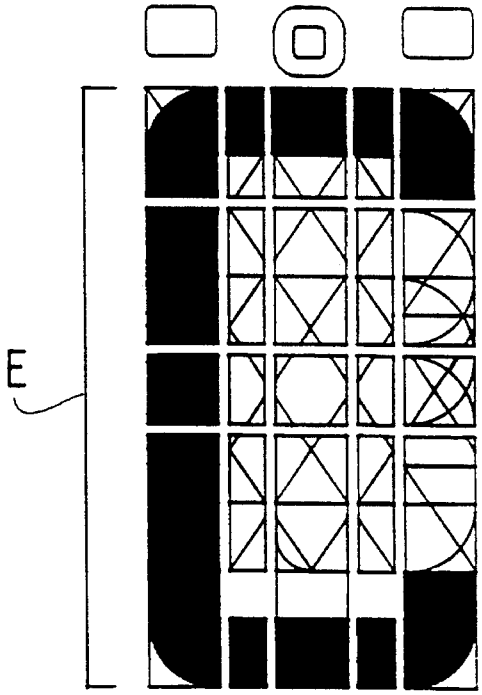
Figure 22:
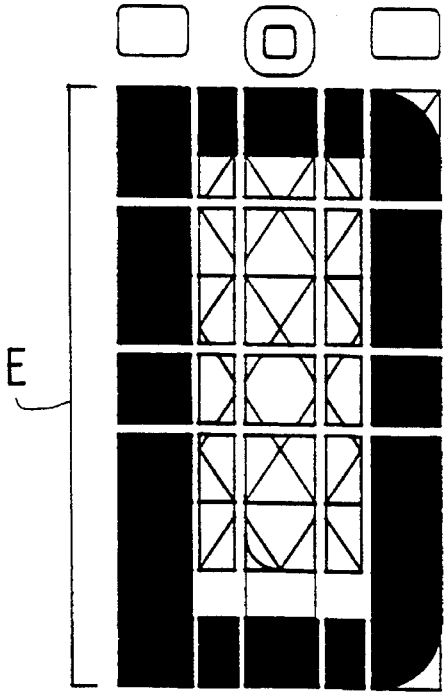
Figure 23:
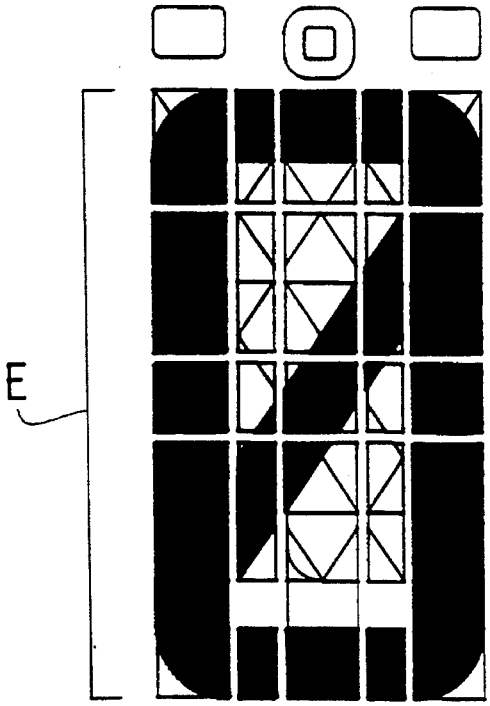
Figure 24:
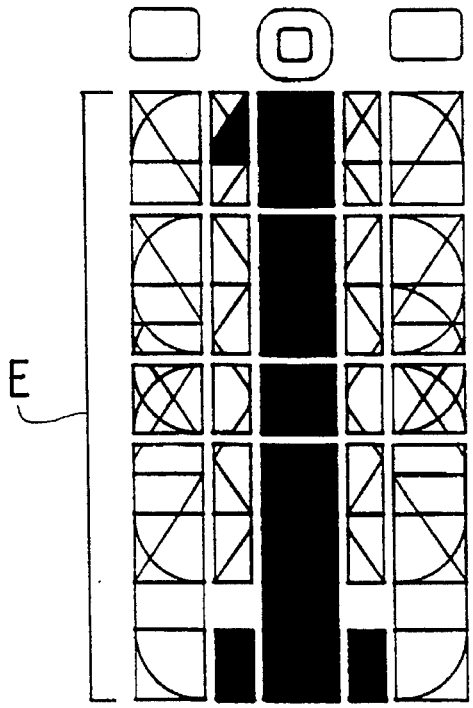
Figure 25:
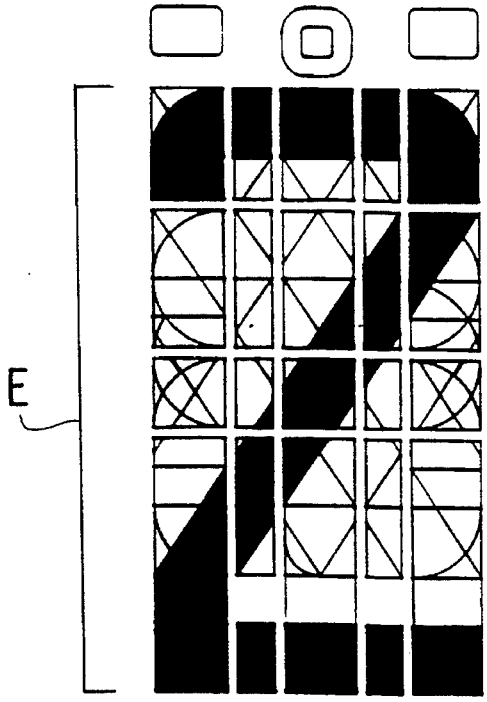
Figure 26:
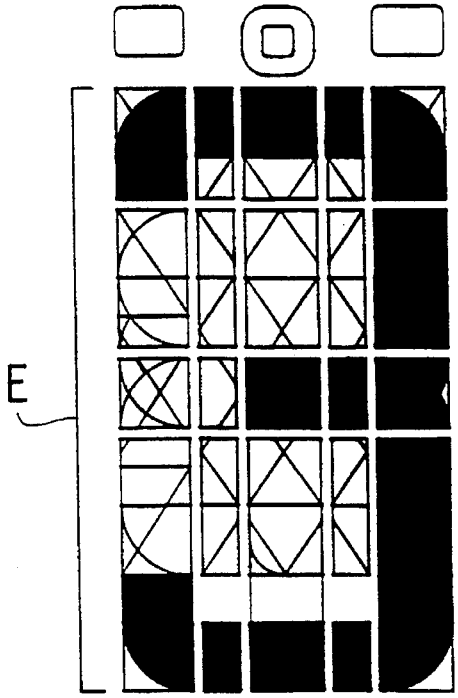
Figure 27:
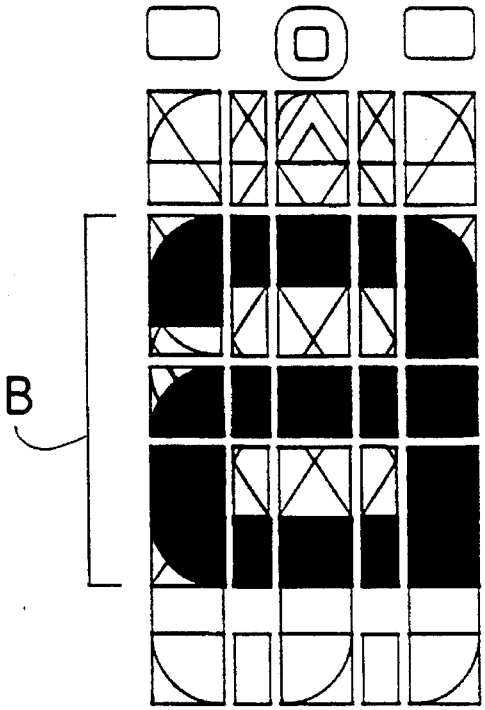
Figure 28:
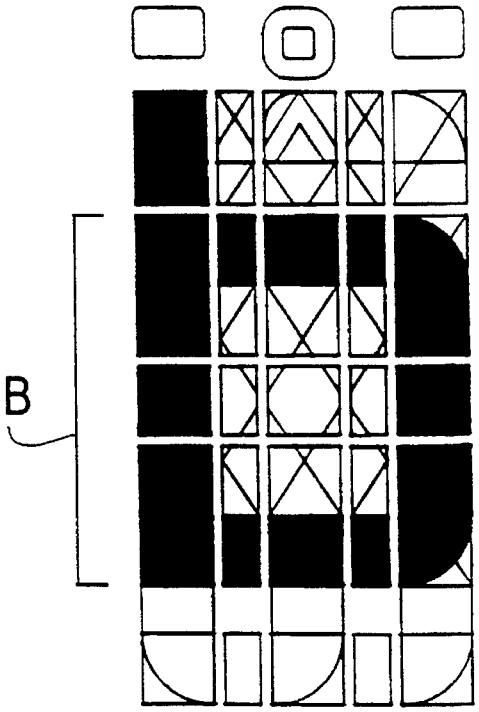
Figure 29:
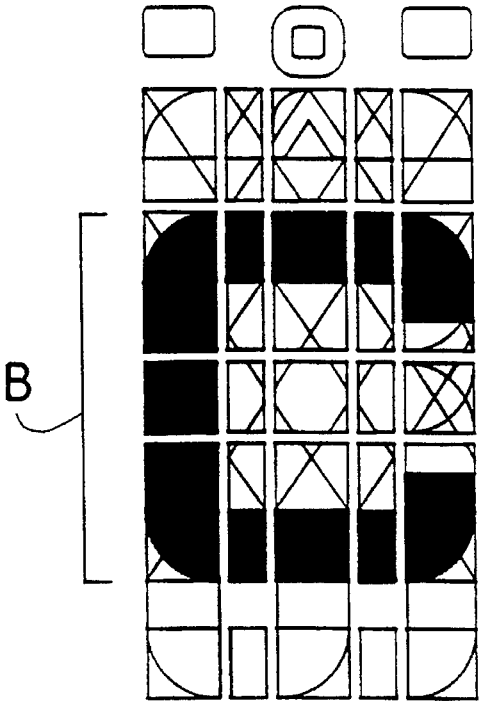
Figure 30:
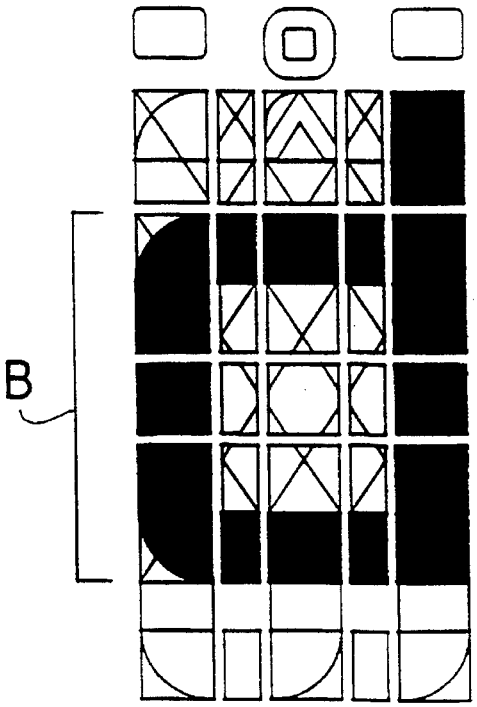
Figure 31:
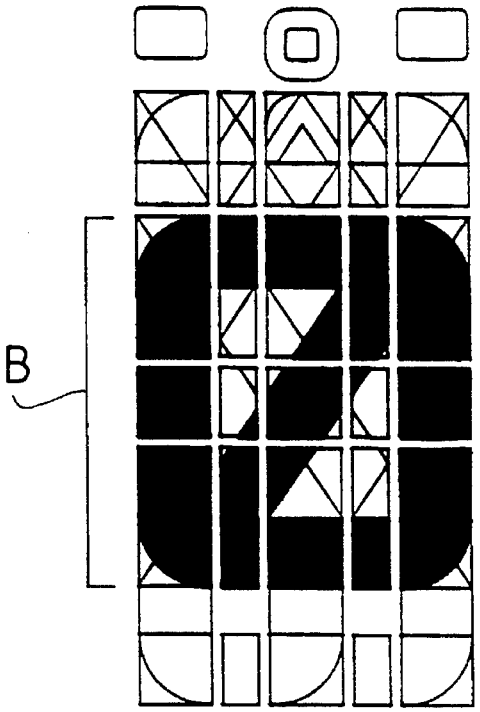
Figure 32:
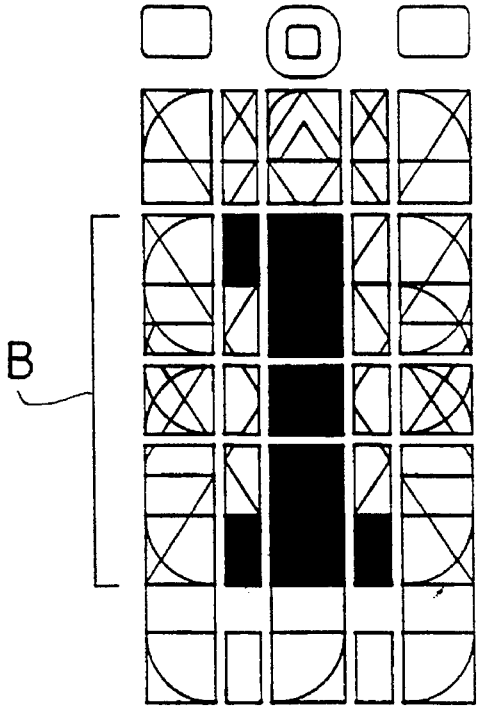
Figure 33:
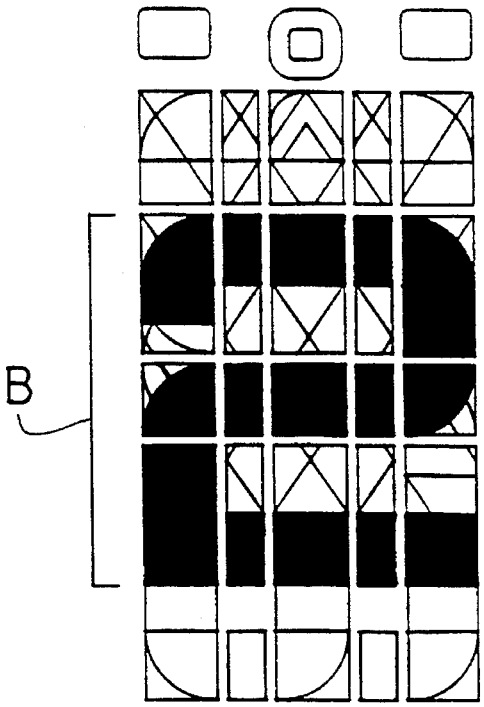
Figure 34:
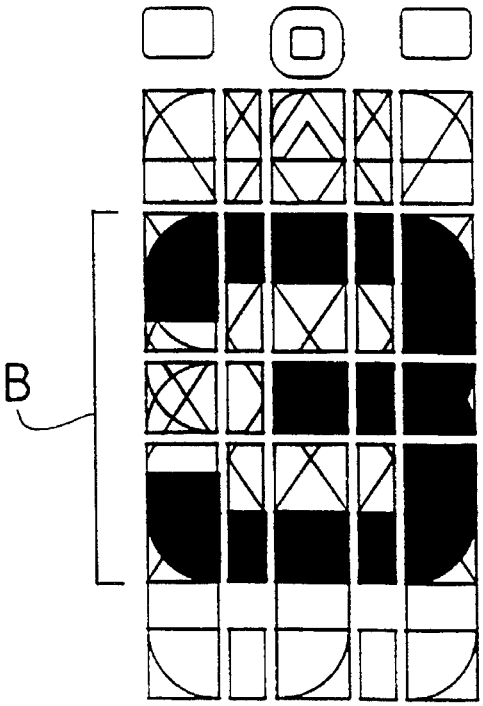
Figure 35:
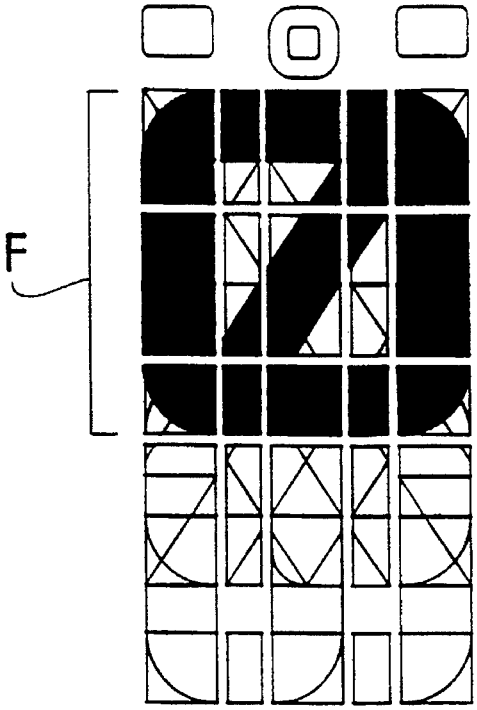
Figure 36:
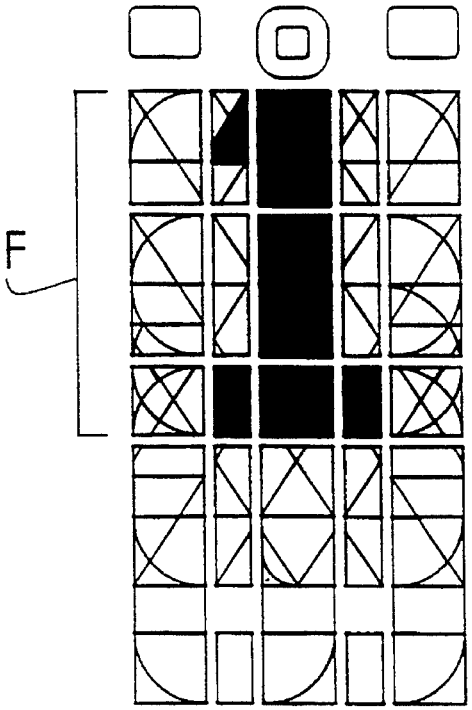
Figure 37:
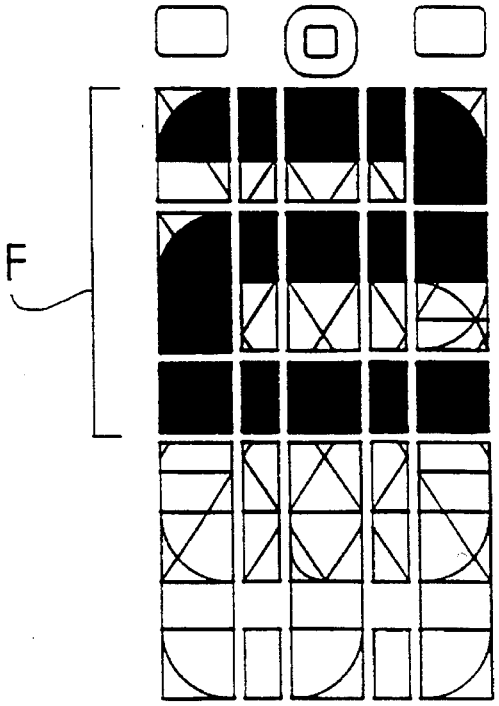
Figure 38:
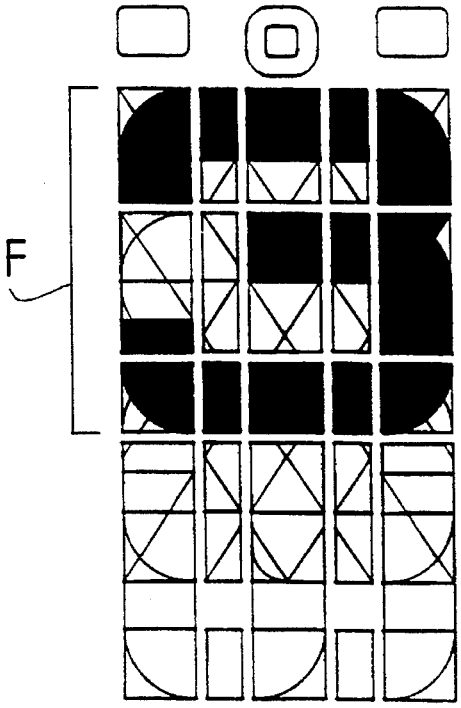

FIG. 10 represents a divided grid $T_4$ which is the result of the operation of FIG. 9 and to which there will thereafter be added insulation spaces Es in order to form in particular accents, downstrokes or round-offs of certain alpha-numeric characters.

As is more precisely seen on FIG. 6, the mosaic according to the invention includes four display zones for alpha-numeric characters of different size.

Effectively, the mosaic according to the invention includes a first display zone A which corresponds to the formation of alpha-numeric characters of average size, and in particular to the formation of a first set of capital letters and digits (FIGS. 11 to 18). Such first zone A employs all the columns and the lines of the mosaic with the exception of the last $L_6$ which corresponds to zone C for formation of the end of downstrokes of large letters and the formation of underlining bars.

Such mosaic includes a second zone E intended to permit the display of alpha-numeric characters of large dimension, namely the large capitals and the large digits. The displayed letters are visible on FIGS. 19 to 26.

As to zone E, it is seen that it uses all the available surface of the mosaic, zone A being thus comprised within zone E.

The third characteristic display zone of such mosaic is zone B which is intended to enable essentially the display of small digits in a first position as will be explained hereinafter, and lower case letters. The lower case letters nevertheless employ for certain tops of letters and downstrokes a portion of zone A and a portion of zone C. Thus, such zone B is comprised in zone A and is arranged directly above the underlining zone C.

The displayable characters thanks to zone B are represented on FIGS. 27 to 34.

The mosaic according to the invention further includes a fourth zone F by which it permits the display of small digits having a position different from those displayed thanks to zone B, namely substantially higher up. Zone F is nested within the interior of zone B which together and in superposition constitute zone A. The displayable characters, thanks to such zone F, are represented on FIGS. 35 to 38. Thus, it is understood that such mosaic includes at least two characteristic zones for the formation of characters of a same family (digits, letters in capital or lower case form), but of different sizes. More precisely, it includes at least two characteristic zones A, B for the formation of digits of different sizes. In a manner still more precise, it includes three characteristic zones A, B, E for the formation of digits including three different sizes, namely large, medium and small.

Finally, it includes a fourth characteristic zone F for the formation of digits and in particular small digits on- different levels respectively upper and lower. It is thus understood that in a very advantageous manner there has been provided a mosaic which is adapted to display, with one and the same grid, namely the divided final grid $T_5$ shown on FIG. 6, different sizes of digits (small, medium and large) and different sizes within the same family of letters (large and small). Thus, one may respond advantageously to the problem of predetermined dimensioning of alpha-numeric characters, such possibility of varying the size with one and the same mosaic also enabling the elimination of a display cell in the case, for instance of displaying the time.

It is evident that this arrangement and this process enable the providing of an extremely substantial number of patterns on one and the same mosaic, which permits stylizing the characters without limit in conserving an excellent definition without affecting the manufacturing cost of the arrangement.

There will also be stipulated that the invention may be applied to an electronic display arrangement having a low multiplexing rate, that is to say, in which certain elementary patterns are coupled electrically among themselves in a manner corresponding to the multiplexing rate. In such case, the counter-electrode 6B must include regions which are electrically isolated from one another and provided with their own electrical connection, and may no longer be monobloc (continuous) as such is for the counter-electrode shown on FIG. 5.

We claim:

1. An electronic display arrangement having at least one electro-optic display means including elementary patterns conforming to and being based on a series of stylized and selected alpha-numeric characters in the form of a composite mosaic type structure, said mosaic-type structure being formed by:

forming in a grid layer curved separations having a width (Y), forming in said grid layer diagonally extending separations having said width (Y), said diagonally extending separations including a first group and a second group of separations with separations in said first group intersecting separations in said second group, forming in said grid layer horizontally extending separations having said width (Y), said curved separations, said diagonally extending separations and said horizontally extending separations dividing said grid layer into a mosaic of elementary patterns of different sizes and shapes, some of said elementary patterns exhibiting homogenous and complementary contours so that one elementary pattern nests within another elementary pattern; and overlaying with a plurality of optically passive bands regions in said grid layer in which said diagonally extending separations intersect, said optically passive bands having first edges which, with said diagonally extending separations, define optically passive regions of small surface, said optically passive bands having a width (X) which is greater than said width (Y) and the widths of said regions of small surface.

2. An arrangement as set forth in claim 1 wherein said optically passive bands are formed in a rectilinear array and are all positioned solely perpendicular or parallel to the reading sense of the characters on the arrangement.

3. An arrangement as set forth in claim 1 wherein said optically passive bands are aligned in continuous or cut up separations which compartmentalize the elementary patterns in groups over the greater portion of said mosaic.

4. An arrangement as set forth in claim 3 including at least two separations or cuts respectively positioned adjacent to regions of the mosaic for forming downstrokes of letters.

5. An arrangement as set forth in claim 4 including four continuous or cut-up separations arranged perpendicular to the reading sense, said four separations or cuts defining five columns, referred to as vertical columns, three of which constitute first and second lateral columns and a central column for forming downstrokes.

6. An arrangement as set forth in claim 5 wherein the three vertical columns for forming downstrokes exhibit equal widths.

7. An arrangement as set forth in claim 5 wherein said five columns comprise first and second intermediate columns, said first intermediate column separating said central column of the three vertical columns for forming downstrokes from said first lateral column for forming downstrokes and said second intermediate column separating said central column of the three vertical columns for forming downstrokes from said second lateral column for forming downstrokes, said first and second intermediate columns being of equal width to one another but of width less than that of said three vertical columns, said first and second intermediate columns being further separated from said three vertical columns through adjacent optically passive bands.

8. An arrangement as set forth in claim 3 wherein said separations or cuts extend over the entire mosaic and open out onto upper and lower edges of the mosaic.

9. An arrangement as set forth in claim 3 including at least two horizontal separations or cuts extending parallel to the reading sense of the characters.

10. An arrangement as set forth in claim 9 wherein the two horizontal separations or cuts are arranged in the neighborhood of zones in which the density of elementary patterns is greatest.

11. An arrangement as set forth in claim 10 wherein said horizontal separations or cuts are located adjacent the greatest density zones.

12. An arrangement as set forth in claim 9 wherein said two horizontal separations or cuts are arranged on either side of, and adjacent to, an intermediate horizontal bar for forming a portion of lower case letters.

13. An arrangement as set forth in claim 12 including a third separation or cut arranged adjacent to and directly above, an upper horizontal lower case bar.

14. An arrangement as set forth in claim 1 wherein said grid layer is divided into a mosaic of elementary patterns capable of displaying different sizes of characters for families of letters and/or numbers with a sole and unique grid.

15. An arrangement as set forth in claim 14 wherein said grid layer is divided into a mosaic including at least two characteristic zones for forming characters of different sizes with the same family.

16. An arrangement as set forth in claim 14 wherein said grid layer is divided into a mosaic including at least two characteristic zones for forming numbers of different sizes.

17. An arrangement as set forth in claim 14 wherein said mosaic includes a first base grid and a second grid which partially duplicates the first base grid to permit forming display zones for characters of different sizes.

18. An arrangement as set forth in claim 17 wherein said second grid is arranged above said first grid in said mosaic.

19. An arrangement as set forth in claim 1 wherein said width (Y) is less than 100 μm and said width (X) is at least 15 times greater than said width (Y).

20. An electronic display arrangement of the type comprising:

at least one electro-optical display means;

said electro-optical display means comprising a plurality of elementary patterns conforming to and being based on a series of stylized and selected alpha-numeric characters, said elementary patterns being of different sizes and shapes and disposed to form a composite mosaic-type structure having a grid formed by said elementary patterns, some of said elementary patterns exhibiting heterogenous and complementary contours arranged so that one elementary pattern nests into another elementary pattern in a manner similar to that of a puzzle, said elementary patterns being spaced with respect to each other by a separation distance (Y) by curved separations, horizontally extending separations and diagonally extending separations, some of said diagonally extending separations being disposed so as to intersect other diagonally extending separations, and optically passive bands dividing up said mosaic-type structure to form a cut-up thereof, said optically passive bands each having a first edge, the first edges of said optically passive bands defining, with said diagonally extending separations, optically passive regions of small size, said optically passive band having a width (X) which is greater than said separation distance (Y), said bands being disposed to overlap said optically passive regions of small size.

* * * * *